US011773546B2

(12) United States Patent
Maus et al.

(10) Patent No.: US 11,773,546 B2
(45) **Date of Patent: *Oct. 3, 2023**

(54) MODULAR TRAVEL WARNING STRIP SYSTEM AND METHODS

(71) Applicant: TRAFFIX DEVICES, INC., San Clemente, CA (US)

(72) Inventors: Geoffrey B. Maus, Trabuco Canyon, CA (US); Felipe Almanza, San Clemente, CA (US); Christopher A. Jaime, San Clemente, CA (US); Jack H. Kulp, Dana Point, CA (US)

(73) Assignee: TRAFFIX DEVICES, INC., San Clemente, CA (US)

( * ) Notice: Subject to any disclaimer, the term of this patent is extended or adjusted under 35 U.S.C. 154(b) by 74 days.

This patent is subject to a terminal disclaimer.

(21) Appl. No.: 17/484,598

(22) Filed: Sep. 24, 2021

(65) Prior Publication Data

US 2022/0010509 A1 Jan. 13, 2022

Related U.S. Application Data

(63) Continuation of application No. 16/370,785, filed on Mar. 29, 2019, now Pat. No. 11,414,822.
(Continued)

(51) Int. Cl.
*E01F 9/529* (2016.01)

(52) U.S. Cl.
CPC ..... *E01F 9/529* (2016.02)

(58) Field of Classification Search
CPC ..... E01F 9/529
See application file for complete search history.

(56) References Cited

U.S. PATENT DOCUMENTS 305,328 A 9/1884 Peck
2,139,816 A 12/1938 Fordyce
(Continued)

FOREIGN PATENT DOCUMENTS

CN 1780967 A 5/2006
CN 101768929 A 7/2010
(Continued)

OTHER PUBLICATIONS

International Search Report and Written Opinion for corresponding PCT App. No PCT/US2019/025035, dated Jul. 16, 2019.
(Continued)

*Primary Examiner* — Thomas B Will
*Assistant Examiner* — Katherine J Chu
(74) *Attorney, Agent, or Firm* — STOUT, UXA & BUYAN, LLP; Donald E. Stout

(57) ABSTRACT

A modular highway warning strip system is formed of a plurality of segments assembled together to create a warning strip assembly having a length, wherein each of the plurality of segments are spaced from adjacent ones of the segments along the warning strip length. The segments are assembled together along a cord disposed along the length of the warning strip assembly. A plurality of spacers are disposed on the cord along the length of the warning strip assembly, between adjacent ones of the segments in order to maintain a spacing between each adjacent segment.

21 Claims, 18 Drawing Sheets

Related U.S. Application Data

(60) Provisional application No. 62/799,024, filed on Jan. 30, 2019, provisional application No. 62/797,894, filed on Jan. 28, 2019, provisional application No. 62/650,958, filed on Mar. 30, 2018.

(56) References Cited

U.S. PATENT DOCUMENTS

| | | | | |
|---|---|---|---|---|
| 3,334,554 | A | 8/1967 | Adams | |
| 3,820,912 | A | 6/1974 | Hughes | |
| 3,880,537 | A | 4/1975 | Harris | |
| 3,961,751 | A | 6/1976 | Kessler | |
| 4,309,124 | A | 1/1982 | Bertels | |
| 4,490,069 | A | 12/1984 | Cushman | |
| 4,681,482 | A | 7/1987 | Arciszewski | |
| 4,964,751 | A | 10/1990 | Rope | |
| 4,998,717 | A | 3/1991 | Vaux | |
| 5,118,542 | A | 6/1992 | McLeod | |
| 5,245,334 | A | 9/1993 | Gebert | |
| 5,282,692 | A | 2/1994 | McLeod | |
| 5,295,759 | A | 3/1994 | Flanders et al. | |
| 5,306,105 | A | 4/1994 | Langbrandner | |
| 5,351,353 | A * | 10/1994 | Walters | E02D 29/045 14/24 |
| 5,450,077 | A | 9/1995 | Tyburski | |
| D387,181 | S | 12/1997 | Sinclair | |
| 5,769,563 | A | 6/1998 | Flynn | |
| 5,775,834 | A | 7/1998 | Jackson | |
| 5,775,838 | A | 7/1998 | Pettee, Sr. | |
| 6,079,898 | A | 6/2000 | St. Amant, III | |
| 6,174,103 | B1 | 1/2001 | Stroman | |
| 6,287,047 | B1 | 9/2001 | Dufresne | |
| 6,309,137 | B1 | 10/2001 | Hirsch | |
| 6,575,660 | B1 | 6/2003 | Davis | |
| 6,623,206 | B1 | 9/2003 | Blair | |
| 7,037,033 | B1 | 5/2006 | Attar | |
| 7,591,605 | B2 | 9/2009 | Jonasz et al. | |
| 7,731,448 | B2 | 6/2010 | Fillie | |
| 7,736,087 | B1 | 6/2010 | Mettler et al. | |
| 8,118,517 | B2 | 2/2012 | Kelley et al. | |
| 8,807,864 | B2 | 8/2014 | Kulkarni et al. | |
| 9,382,937 | B2 | 7/2016 | Davies | |
| 9,683,339 | B2 | 6/2017 | Thompson | |
| 9,783,941 | B1 | 10/2017 | Kulp et al. | |
| 10,106,938 | B1 | 10/2018 | Kulp et al. | |
| 10,221,530 | B2 | 3/2019 | Driskell | |
| 11,414,822 | B2 * | 8/2022 | Maus | E01F 9/529 |
| 11,535,993 | B2 * | 12/2022 | Maus | E01F 9/529 |
| 2003/0194371 | A1 | 10/2003 | Lehmann et al. | |
| 2007/0042159 | A1 | 2/2007 | Sugihara et al. | |
| 2007/0258764 | A1 | 11/2007 | Broughton | |
| 2008/0260458 | A1 | 10/2008 | Fillie | |
| 2010/0158607 | A1 | 6/2010 | Mettler | |
| 2010/0215431 | A1 | 8/2010 | Mettler et al. | |
| 2011/0048843 | A1 | 3/2011 | Zeleny | |
| 2011/0150569 | A1 | 6/2011 | Christensen | |
| 2013/0266375 | A1 | 10/2013 | Shaw | |
| 2014/0190395 | A1 | 6/2014 | Cowan | |
| 2014/0270937 | A1 | 9/2014 | Kulkarni et al. | |
| 2014/0270942 | A1 | 9/2014 | Smith et al. | |
| 2015/0030390 | A1 | 1/2015 | Brown et al. | |
| 2015/0110554 | A1 | 4/2015 | Mettler et al. | |
| 2015/0216021 | A1 | 7/2015 | Bennett | |
| 2015/0376849 | A1 | 12/2015 | Thompson et al. | |
| 2018/0099647 | A1 | 4/2018 | Goff et al. | |

FOREIGN PATENT DOCUMENTS

| | | | |
|---|---|---|---|
| EP | 0388650 | A1 | 9/1990 |
| EP | 2789745 | A1 | 4/2014 |
| FR | 2699199 | A1 | 6/1994 |
| GB | 485673 | A | 5/1938 |
| GB | 520155 | A | 4/1940 |
| GB | 2030197 | A | 4/1980 |
| GB | 2086967 | A | 5/1982 |
| GB | 2104946 | A | 3/1983 |
| GB | 2240801 | A | 8/1991 |
| GB | 2568322 | A | 5/2019 |
| JP | 2005-098021 | A | 4/2005 |
| KR | 200361409 | Y1 | 9/2004 |
| KR | 10-2009-0126365 | A | 12/2009 |
| KR | 10-2011-0130230 | A | 12/2011 |
| KR | 20120058357 | A | 6/2012 |
| WO | 2010/056142 | A1 | 5/2010 |

OTHER PUBLICATIONS

Youtube Video: "TrafFix Alert Rumble Strips" (TrafFix Devices) Feb. 25, 2013 (Sep. 25, 2013) entire video. URL: <<https://www.youtube.com/watch?v=FA16010UM24>>.

Office Action dated Jul. 21, 2021 in corresponding Chinese Patent App. No. 201980019830.X.

Supplementary European Search Report dated Nov. 22, 2021 in connection with corresponding EP App. No. 19775515.0.

* cited by examiner

MODULAR TRAVEL WARNING STRIP SYSTEM AND METHODS

This application is a continuation under 35 U.S.C. 120 of U.S. application Ser. No. 16/370,785, entitled Modular Travel Warning Strip System and Methods, filed on Mar. 29, 2019, which in turn claims the benefit under 35 U.S.C. 119(e) of the filing date of U.S. Provisional Application Ser. No. 62/650,958, entitled Modular Travel Warning Strip System and Methods, filed on Mar. 30, 2018, and of U.S. Provisional Application Ser. No. 62/797,894, entitled Modular Travel Warning Strip System and Methods, filed on Jan. 28, 2019, and of U.S. Provisional Application Ser. No. 62/799,024, entitled Modular Travel Warning Strip System and Methods, filed on Jan. 30, 2019. All of the foregoing applications are commonly assigned with the present application, and are each expressly incorporated herein by reference, in their entirety.

BACKGROUND OF THE INVENTION

Warning or, more popularly, rumble strips are well known in the highway industry, particularly for high speed highway applications in order to provide an easily detectable noise and vibration, when driven over. They are typically used to warn approaching drivers of a hazard ahead, such as a toll booth, the end of a freeway, a sharp curve, or the like. Permanent rumble strips are placed in the pavement of the roadway for such permanent hazards as are described above. In other circumstances, where the hazard is temporary, such as a construction zone, vehicular accident, checkpoint, or the like, temporary rumble strips may be useful. Such a temporary rumble strip system is disclosed in U.S. Pat. No. 7,736,087 to Mettler et al., which patent is herein expressly incorporated by reference.

SUMMARY OF THE INVENTION

The invention described herein is a portable rumble or warning strip system which has a number of advantages compared to prior art systems of the type. One such advantage is that the system can be produced at a significantly lower cost, because of improved molding techniques and the ability to utilize recycled and lower cost rubber materials. This advantage, of course, affords a significant environmental benefit compared to prior art products molded of relatively expensive polyurethane. Other advantages include greater ease of assembly and disassembly, availability in a variety of colors, a carrying handle for ease of transport, stacking lugs for easy stackability of multiple modules, jigsaw style connections for maximum assembly options, and lengthwise metallic cables to offer stability and additional weight.

More particularly, there is provided a modular highway warning strip system which comprises a first plurality of segments assembled together to form a first warning strip subassembly having a length, each of the first plurality of segments being spaced from adjacent ones of the first plurality of segments along the first warning strip subassembly length, the first plurality of segments being assembled together along a first cord disposed along the length of the first warning strip subassembly. The system further comprises a second plurality of segments assembled together to form a second warning strip subassembly having a length, each of the second plurality of segments being spaced from adjacent ones of the second plurality of segments along the second warning strip subassembly length, the second plurality of segments being assembled together along a second cord disposed along the length of the second warning strip subassembly. The first warning strip subassembly has, at a first end thereof, a first jigsaw member comprising a connecting edge, and the second warning strip subassembly has, at a first end thereof, a second jigsaw member comprising a connecting edge, the first and second connecting edges being configured to engage with one another to create a flush connection with the first and second jigsaw members, thereby creating a joined jigsaw segment and consequent joining of the first warning strip subassembly and the second warning strip subassembly at a selected site. This forms a warning strip assembly on the selected site, the joined jigsaw segment being separable from each of the first and second warning strip subassemblies.

A plurality of spacers are disposed on each of the first and second cords along the length of each of the first and second warning strip subassemblies, each of the plurality of spacers being disposed between adjacent ones of the first and second plurality of segments in order to maintain a spacing between each adjacent segment. Each of the spacers comprise a hollow structure sized to be disposed about one of the first and second cords. The spacers may comprise a tube formed of a corrosion-resistant material.

Each of the plurality of segments preferably comprises an opening disposed therethrough for receiving one of the first and second cords. A second opening is disposed through each of the first plurality of segments and the second plurality of segments for receiving the other one of the first and second cords. In the illustrated embodiment, the first cord exits from one of the openings in an endmost segment on a second end of the first warning strip subassembly, extends in an arc toward the second opening on the endmost segment, and enters the second opening, thereby forming a handle loop on the second end of the first warning strip subassembly, the arc defining a space between the handle loop and the endmost segment sufficient to receive a human hand. The second cord exits from one of the openings in an endmost segment on a second end of the second warning strip subassembly, extends in an arc toward the second opening on the endmost segment of the second warning strip subassembly, and enters the second opening, thereby forming a handle loop on the second end of the second warning strip subassembly, the arc also defining a space between the second handle loop and the endmost segment sufficient to receive a human hand, wherein there is a handle disposed on each end of the warning strip assembly when the first and second warning strip subassemblies are joined together.

Each of the first and second jigsaw members, in an illustrated embodiment, comprise an opposing straight edge in addition to the connecting edge, the connecting edge of each of the first and second jigsaw members comprising a series of protrusions and concavities which are adapted to engage with the connecting edge of the other jigsaw member, such that when the first and second jigsaw members are joined together by engagement of their respective connecting edges, a jigsaw segment is formed. The first and second jigsaw members are substantially identical in construction.

In exemplary embodiments, some or all the surfaces of each segment are covered with a protective material, which may comprise urethane.

In some exemplary embodiments, one or more of the plurality of segments may be a darker color and one or more of the plurality of segments may be a lighter color. The lighter colored segments and the darker colored segments are preferably assembled in alternating fashion, and alternating ones of the plurality of segments may be formed of different materials. For example, some of the segments may be formed of steel and others of the segments may be formed of aluminum.

In another aspect of the invention, there is provided a modular highway warning strip system, which comprises a first plurality of segments assembled together to form a first warning strip subassembly having a length, wherein the first plurality of segments are assembled and secured together using a first type of connecting system which comprises spacers to ensure separation between each of the plurality of segments, as well as a second plurality of segments assembled together to form a second warning strip subassembly having a length, wherein the second plurality of segments are assembled and secured together using the first type of connecting system which comprises spacers to ensure separation between each of the plurality of segments.

A second type of connecting system, comprising connecting members joinable together, is utilized to join the first warning strip subassembly and the second warning strip subassembly together to form a warning strip assembly having a length longer than the length of either of the first and second warning strip subassemblies, the second type of connecting system being separable from each of the first and second warning strip subassemblies.

The connecting segments, in exemplary embodiments, may comprise a first jigsaw member disposed on an end of the first warning strip subassembly and a second jigsaw member disposed on an end of the second warning strip subassembly. Each of the first and second jigsaw members comprise a straight edge and an opposing connecting edge, the connecting edge of each of the first and second jigsaw members comprising a series of protrusions and concavities which are adapted to engage with the connecting edge of the other jigsaw member, such that when the first and second jigsaw members are joined together by engagement of their respective connecting edges. A flush connection between the first and second jigsaw members is formed, thereby creating a joined jigsaw segment and consequent joining of the first warning strip subassembly and the second warning strip subassembly at a selected site, to form the warning strip assembly on the selected site. As illustrated, the first and second jigsaw members are substantially identical in construction.

The first type of connecting system comprises a first cord disposed along the length of the first warning strip subassembly, extending through holes bored through each of the first plurality of segments, the spacers being disposed on the first cord between adjacent ones of the first plurality of segments, and a second cord disposed along the length of the second warning strip subassembly, extending through holes bored through each of the second plurality of segments, the spacers being disposed on the second cord between adjacent ones of the second plurality of segments.

In yet another aspect of the invention, there is provided a modular highway warning strip system which comprises a first plurality of segments assembled together to form a first warning strip subassembly having a length, wherein the first plurality of segments are assembled and secured together using a first type of connecting system which comprises spacers to ensure separation between each of the plurality of segments. A second plurality of segments is assembled together to form a second warning strip subassembly having a length, wherein the second plurality of segments are assembled and secured together using the first type of connecting system which comprises spacers to ensure separation between each of the plurality of segments. A second type of connecting system, comprising connecting members joinable together, is utilized to join the first warning strip subassembly and the second warning strip subassembly together to form a warning strip assembly having a length longer than the length of either of the first and second warning strip subassemblies, the second type of connecting system being separable from each of the first and second warning strip subassemblies. A handle sized and configured to receive an adult human hand is disposed on an end of the warning strip assembly.

The handle may comprise a first handle disposed on an end of the first warning strip subassembly and a second handle is disposed on an end of the second warning strip subassembly. The first handle is formed from an arc of the first cord extending from and into the end of the first warning strip subassembly and the second handle is formed from an arc of the second cord extending from and into the end of the second warning strip subassembly.

The invention, together with additional features and advantages thereof, may best be understood by reference to the following description taken in conjunction with the accompanying illustrative drawings.

DESCRIPTION OF THE INVENTION

Figure 1:
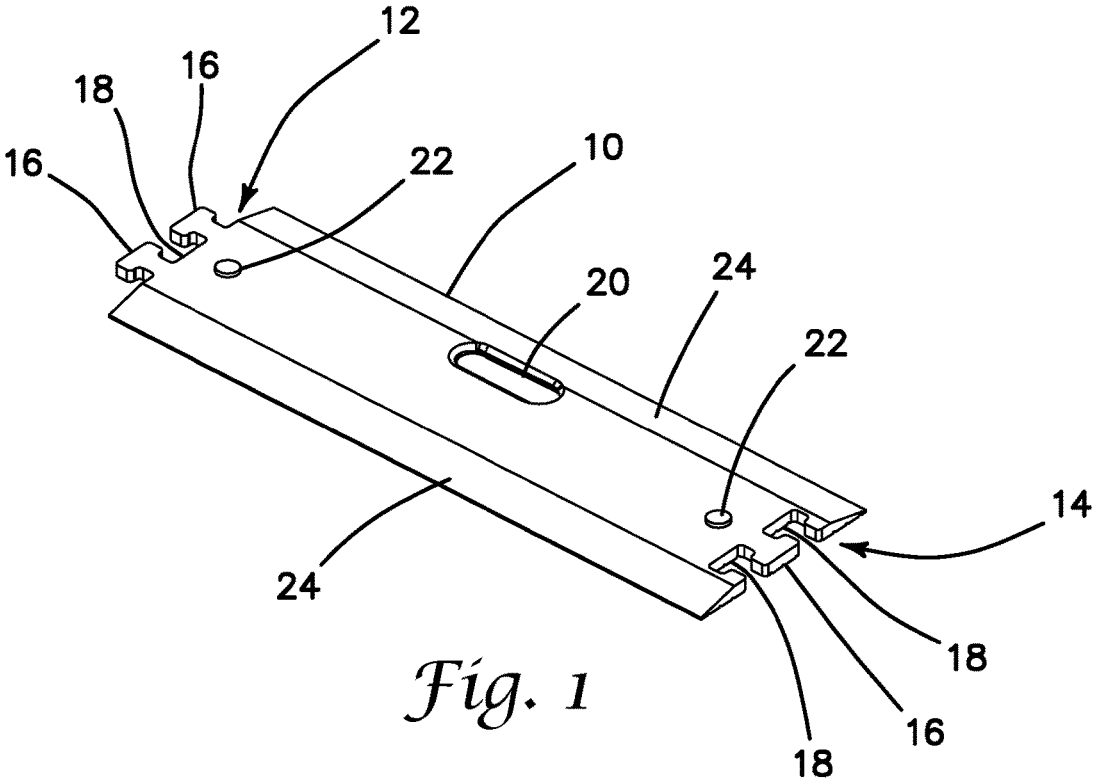
FIG. 1 is an isometric view of a modular warning strip segment constructed in accordance with one exemplary embodiment of the invention.

Referring now more particularly to the drawings, there is shown in FIGS. 1-6 one exemplary embodiment of a modular warning strip segment or traffic control bump 10 having a first end 12 and a second end 14, wherein each end comprises male protrusions 16 and female receptacles 18 adapted for joining adjacent opposed ends of similar segments 10 for the purpose of configuring a desired warning strip configuration. The segment 10 in the illustrated embodiment is comprised of rubber. The rubber may be, preferably, recycled rubber. Generally, the color of the material forming the segment is black, but other colors may be utilized, such as orange and white, and variations, such as using yellow portions along each lengthwise side, may be utilized. A handle 20 is formed in the segment for convenient transport. The handle 20 is preferably large enough to accommodate a gloved hand. Male stacking lugs 22, with corresponding female recesses (not shown) in the underside surface of the segment 10, may be formed on each end, if desired, but are not required. Also, of course, the location of the stacking lugs and corresponding female recesses along the top and bottom surfaces of the segment 10 may vary as desired. Each lengthwise side of the segment 10 comprises a downwardly ramped portion 24, to a thinner profile compared to the full thickness of the center portion of the segment, to assist traversal over the segments. The bidirectional ramp feature eliminates the issue of orientation of the segment on the roadway. In the illustrated embodiments, the ramps 24 are sloped at an angle of approximately 10-15 degrees, though that angle may be varied if desired. Advantageously, the jigsaw ends of each segment may also function as a handle if desired.

Figure 8:
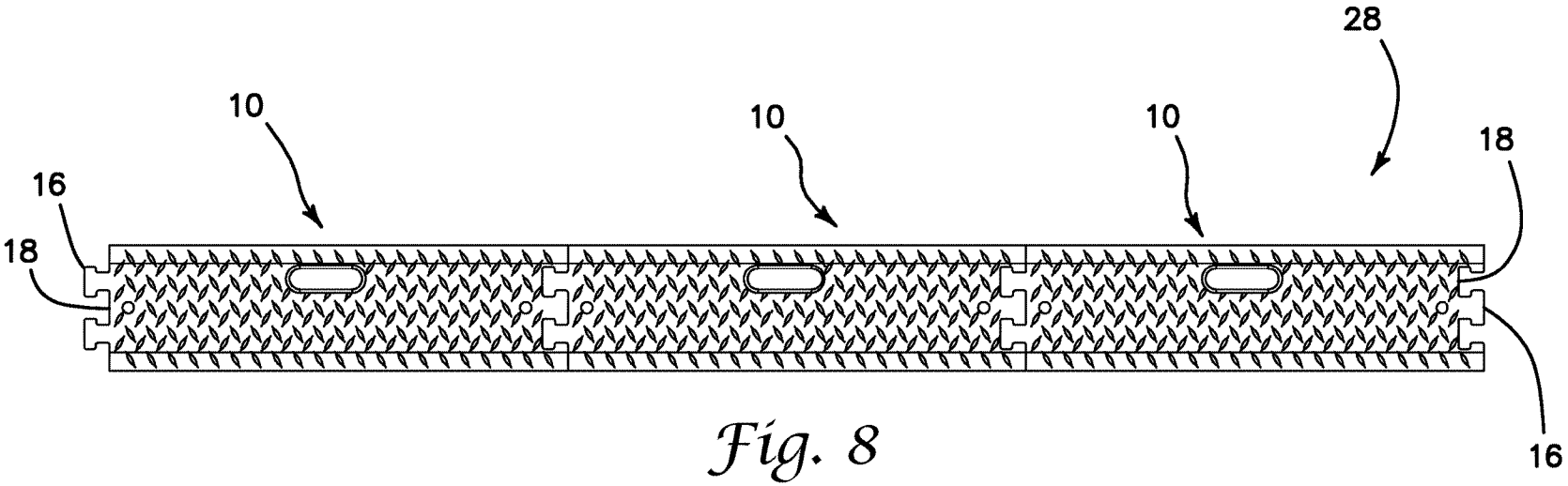
FIG. 8 illustrates three modular warning segments of the invention which have been joined together in end-to-end fashion.
Figure 9:
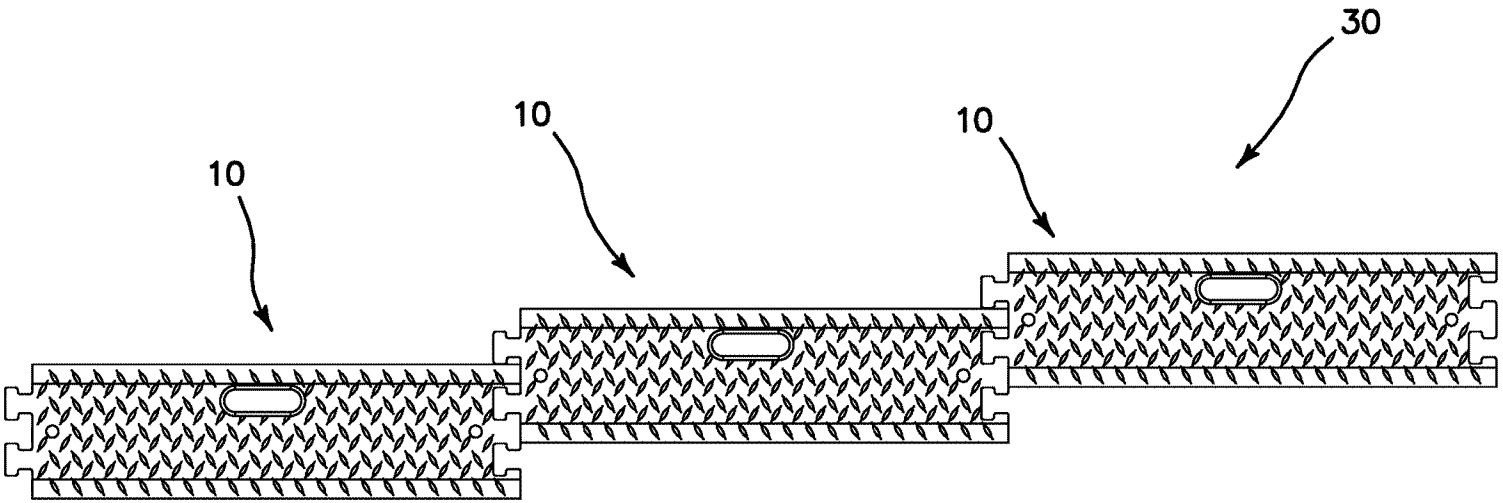
FIG. 9 is a view similar to FIG. 8 illustrating another exemplary option for joining the modular warning segments of the invention together in an offset relationship.
Figure 10:
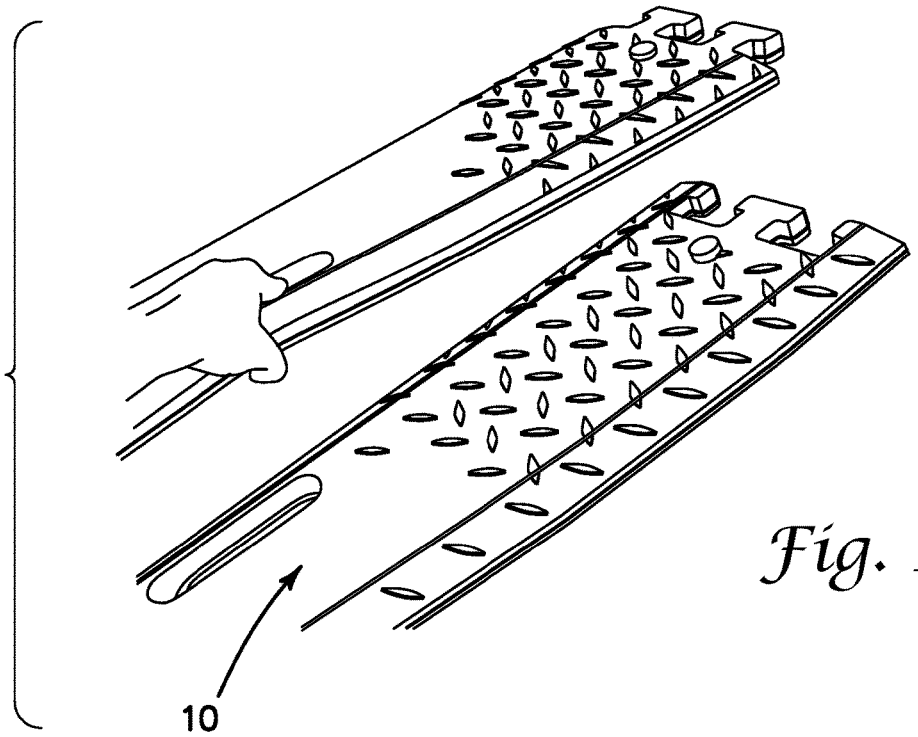
FIG. 10 illustrates another exemplary embodiment of the modular warning segments of the invention which have been constructed in a sandwich fashion for the purpose of having multiple colors.

In one particular embodiment, the full thickness of each segment is about 1½ inches, and each segment 10 is about 46 to 46½ inches in length. The width of each segment is about 12 inches in some embodiments and about 13 inches in others. Other embodiments may employ varying thicknesses, such as about 1 inch or about 0.75 inches. Each segment may weigh between about 24 and 40 lb. Joining three segments 10 together, as shown in FIGS. 8 and 9, will create a warning strip which covers approximately the width of one typical roadway travel lane of 11 to 12 feet. The dimensions discussed throughout this application are representative only—variations are possible and even desirable, depending upon particular application.

Figure 11:
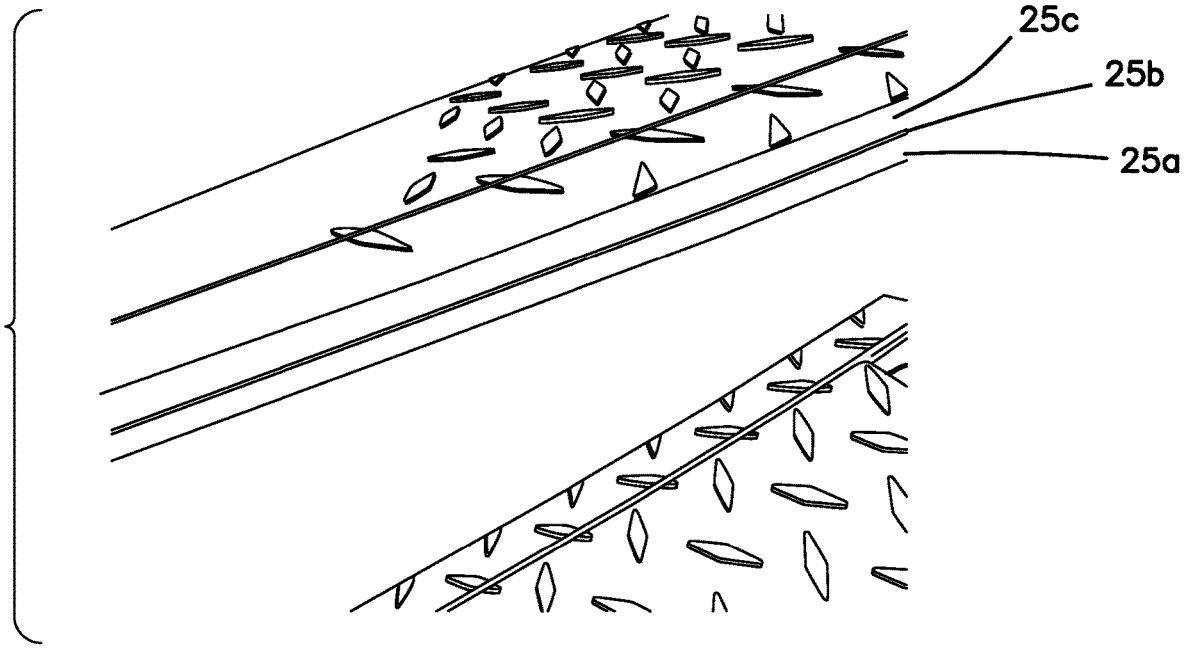
FIG. 11 is another view of a modular warning segment of the present invention having a sandwich construction.
Figure 12:
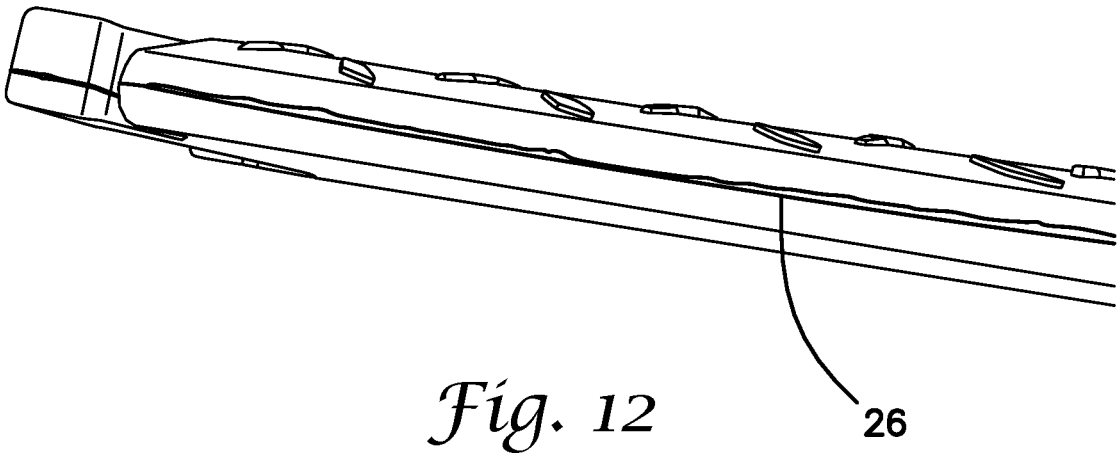
FIG. 12 is yet another view of a modular warning segment of the present invention having a sandwich construction.
Figure 13:
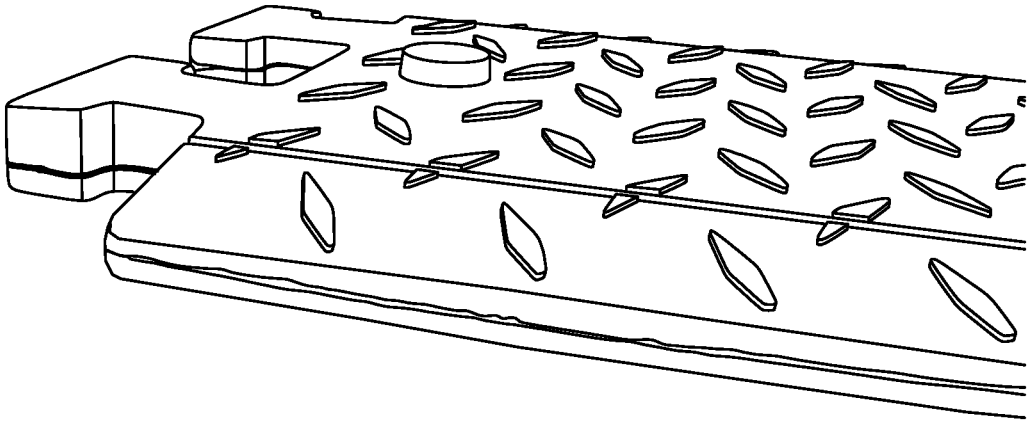
FIG. 13 is still another view of a modular warning segment of the present invention having a sandwich construction.

FIGS. 10-13 illustrate a unique alternative sandwich construction for the segments 10 of the present invention, to permit production of segments 10 in multiple colors. The segment 10 is made as a sandwich. As shown in FIG. 11, a thin layer 25*a* of colored vulcanizable rubber is laid into a mold, after which a second layer 25*b* of inexpensive black vulcanizable rubber is laid on top of the first layer. Then, a third thin layer 25*c* of colored vulcanizable rubber is laid on top of the second black layer 25*b*. This sandwich is then pressed and vulcanized into a finished part. Externally, the finished part has the appearance of a solid colored part, which the exception of the parting line 26 as shown, for example, in FIG. 12. An advantage of this approach is that the part is much less expensive to produce, as the black core rubber is much less expensive. The core rubber does not need to be U.V. stabilized, or have other expensive additives, as it is inside the protective shell of the colored outer layers.

As noted above, FIGS. 8 and 9 illustrate two exemplary approaches for deploying the modular warning segments 10 to create a rumble or warning strip assembly 28 or 30, respectively. In FIG. 8, the assembly 28 is merely three segments 10 joined end-to-end using the respective male protrusions 16 and female receptacles 18, respectively, wherein male protrusions 16 on one end of a segment 10 are inserted into corresponding female receptacles on the opposing end of an adjacent segment 10, the female receptacles 18 being open, so that the engagement of the male protrusions 16 into corresponding female receptacles 18 is in the fashion of the joining together of jigsaw puzzle pieces. Accordingly, a flush engagement of the opposing segment ends is created, as shown. On the other hand, FIG. 9 illustrates one example of the versatility of the inventive system, in that the segments 10 are designed for offset joinder as well, in either offset direction, because any male protrusion 16 is adapted for flush engagement with any female receptacle 18. This versatility allows for the creation of warning strip assemblies having a great number of different orientations, thereby maximizing the functionality of the inventive system. As shown in FIG. 9, by offsetting the connections between adjacent segments 10, a warning strip assembly 30 has a total width of approximately 22 inches in the illustrated example, rather than the width of warning strip assembly 28, which is limited to the width of a single segment 10, or about 12 inches in the illustrated embodiment. In other words, each segment 10 is offset about 5 inches relative to adjacent segments, when joined in the illustrated offset manner. However, the total length of the assembly remains the same as for the FIG. 8 assembly 28—approximately 11 ft, 2½ inches in one representative embodiment.

Figure 2:
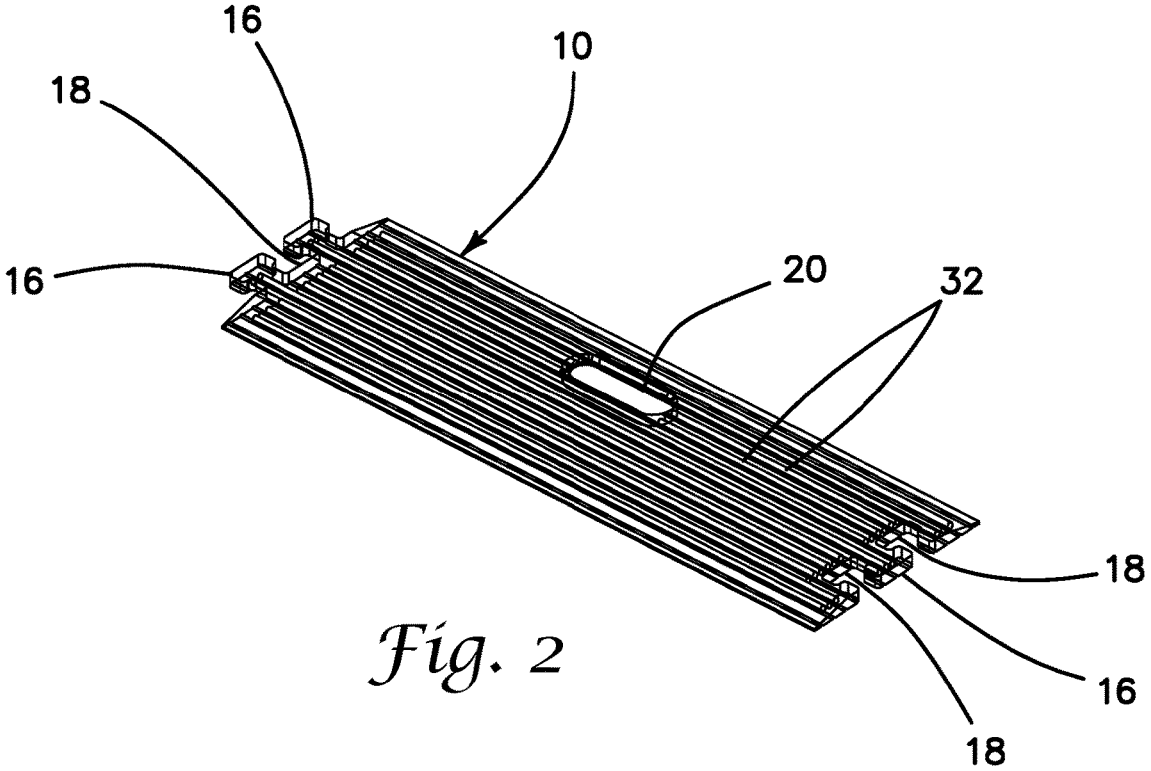
FIG. 2 is a view similar to that of FIG. 1, wherein hidden lines are shown in order to reveal the internal construction of the segment.
Figure 3:
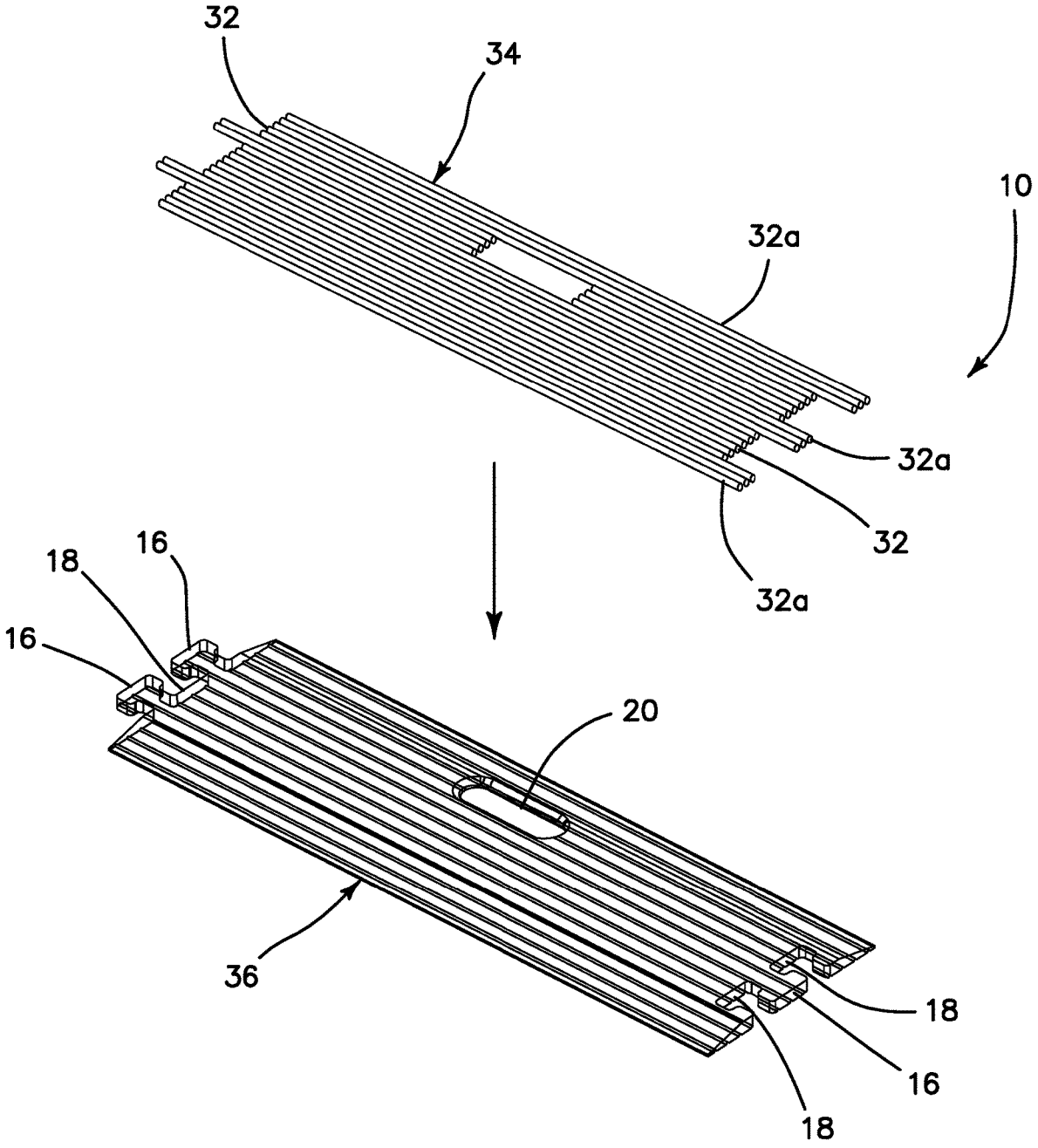
FIG. 3 is an isometric view similar to FIGS. 1 and 2 illustrating a steel cable mat which forms a part of the inventive warning strip segment apart from the molded segment.
Figure 4:
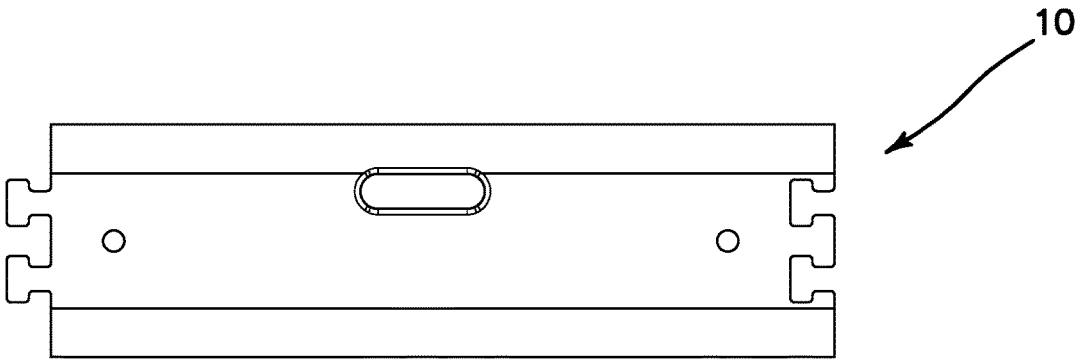
FIG. 4 is a top view of the inventive modular warning strip segment of FIG. 1.
Figure 5:
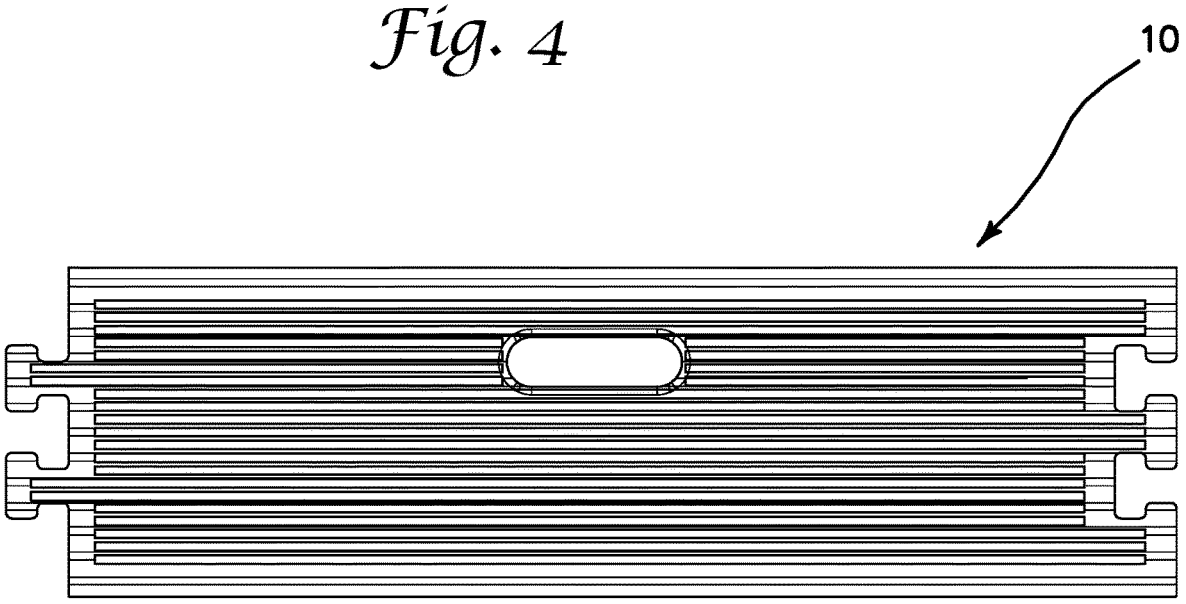
FIG. 5 is a top view similar to FIG. 4, of the modular warning segment as it is shown in FIG. 2, with hidden lines shown for clarity.
Figure 6:
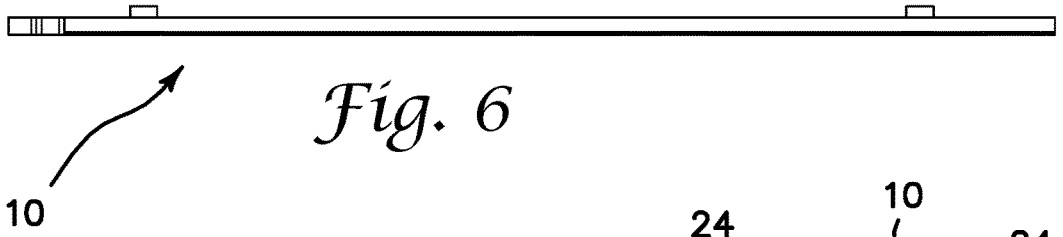
FIG. 6 is a side view of the warning segment of FIGS. 1 and 4.
Figure 7:
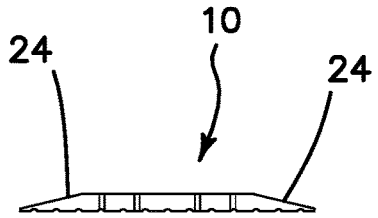
FIG. 7 is an end view of the warning segment of FIGS. 1 and 4.

Although the inventive segments 10 may simply be comprised of molded rubber, preferably recycled rubber, or of a sandwich construction, as shown in FIGS. 10-13, a particularly advantageous embodiment of the present invention is illustrated in FIGS. 2, 3, and 5. Applicant has discovered that it is particularly beneficial to mold the segment 10 to include a plurality of metallic cables 32 running lengthwise within the segment. As shown in FIG. 3, these cables 32 may be formed as a single cable mat 34, preferably formed of corrosion-resistant steel cables 32, though the cable material may be varied depending upon application. The mat 34 is molded together with a molded rubber segment 36, such as vulcanized rubber, to form the segment 10 shown in FIG. 2.

Notably, as shown, some of the cables 32*a* forming the cable mat 34 have an extended length so that they extend into the male protrusions 16 on both ends of the segment 10, once the cable mat 34 is molded into the rubber mat 36.

Advantageously, the steel cables 32, 32*a* running lengthwise along the segments 10 provide added weight for each segment 10, which allows for the use of less rubber to make the segment, thereby saving cost and bulk. More significantly, the cables function to substantially stiffen and strengthen the projections 16 to significantly improve the connection between adjacent segments 10, as well as strengthening the ramps 24 on each side of the segment.

Referring now to FIGS. 14-19, there is shown in these figures a modified embodiment of a modular warning strip segment 10 constructed in accordance with the principles of the present invention. In connection with these figures, like elements will be identified by like reference numerals to those used in connection with FIGS. 1-13. In this embodiment, rather than using the cables 32, 32*a* to reinforce the rubber segment 10, a segmented metallic plate 38 is utilized (FIGS. 15-19). The plate 38, preferably fabricated of steel, adds critical ballast weight of about 32 lb. Including about 12 lb of rubber encasing the steel plate, the combined weight of the entire assembly 10 is about 44 lb., in one particular embodiment. Of course, size and weight of the foregoing described parts may change within the scope of the inventive system, depending upon application.

Figure 15:
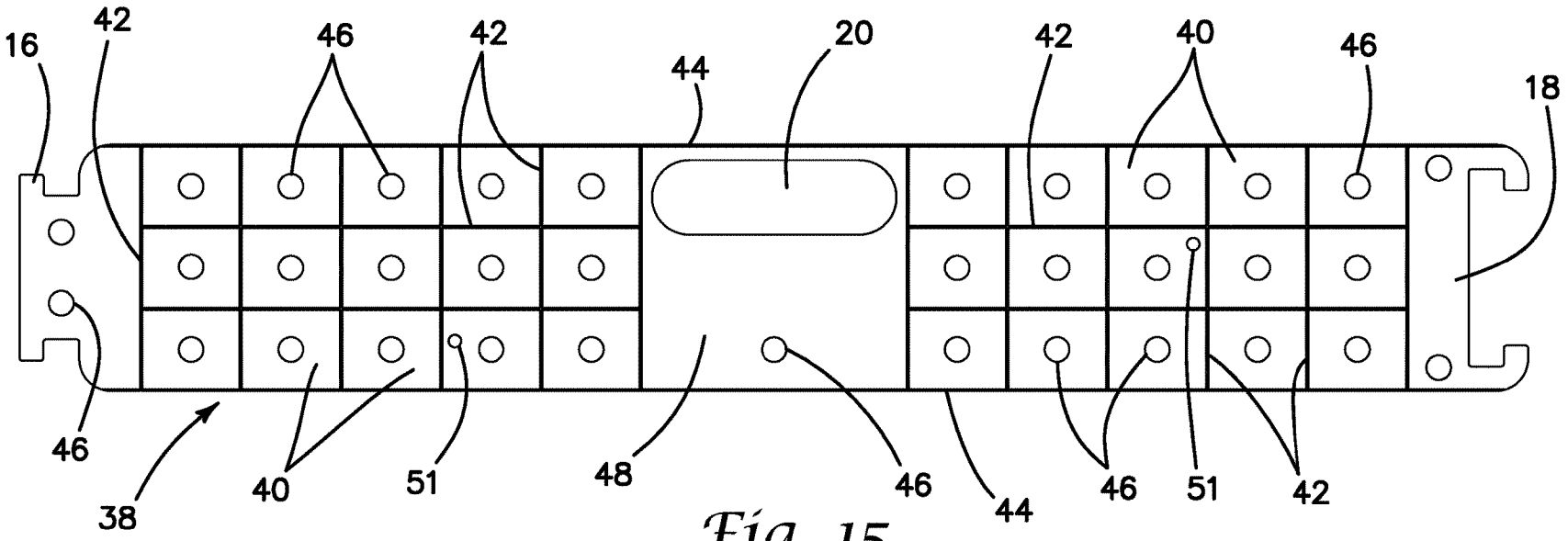
FIG. 15 is a top view of a metallic plate, preferably of steel, for providing internal support for the modular warning strip segment of FIG. 14.
Figure 17:
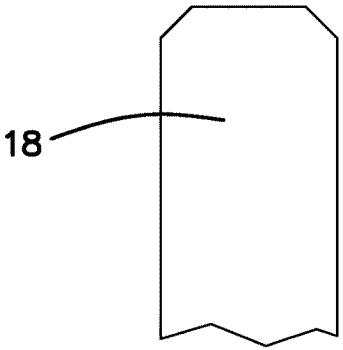
FIG. 17 is a detail view of the portion A of FIG. 16.
Figure 16:
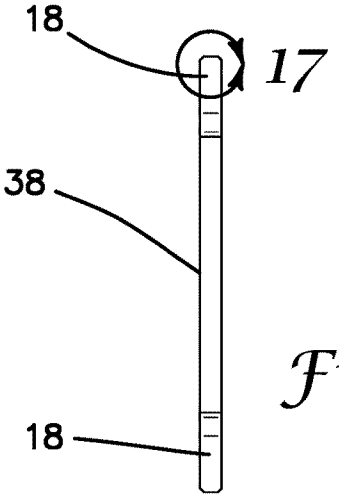
FIG. 16 is an end view of the metallic plate of FIG. 15.

As shown in FIG. 15, the segmented plate 38 is formed of a plurality of segments or ballast blocks 40 separated from one another by living hinges 42, and is, in one embodiment, about 9 inches wide. In one embodiment, each block 40 is about 4 inches long and about 3 inches wide. These living hinges 42 comprise slits or slits made in the surface of the metallic plate 38, both lengthwise and widthwise in a grid, which are preferably laser-cut, though other suitable scoring methods may be used as well. The slits or living hinges 42, are 0.005-1/16 in. in width, in certain embodiments. The plate 38 has two lengthwise edges 44. In certain embodiments, the slits 42 extend entirely through the thickness of the plate 38, except for a plurality of lands of metal extending across the width of the slit 42 from one segment 40 to the next, in spaced relationship along the length of the particular slit 42, which may be of either a reduced thickness or of the full thickness of the plate 38. In other embodiments, the slits 42 may only extend through a partial thickness of the plate 38, though the depth of the slit must be sufficient to permit adjacent segments or blocks 38 to flex and bend relative to one another.

Figure 18:
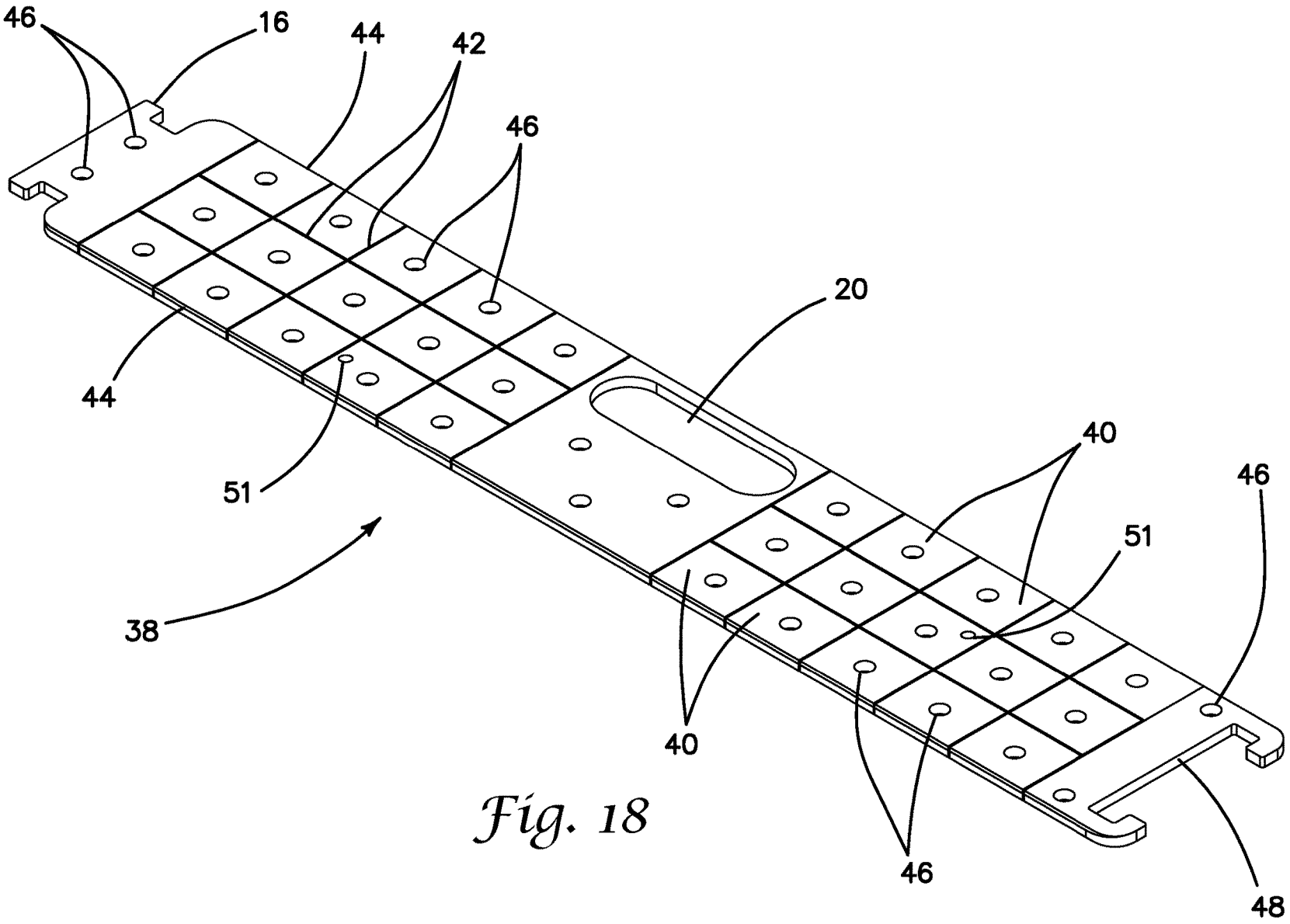
FIG. 18 is an isometric view of a metallic plate similar to that shown in FIGS. 15-17.
Figure 19:
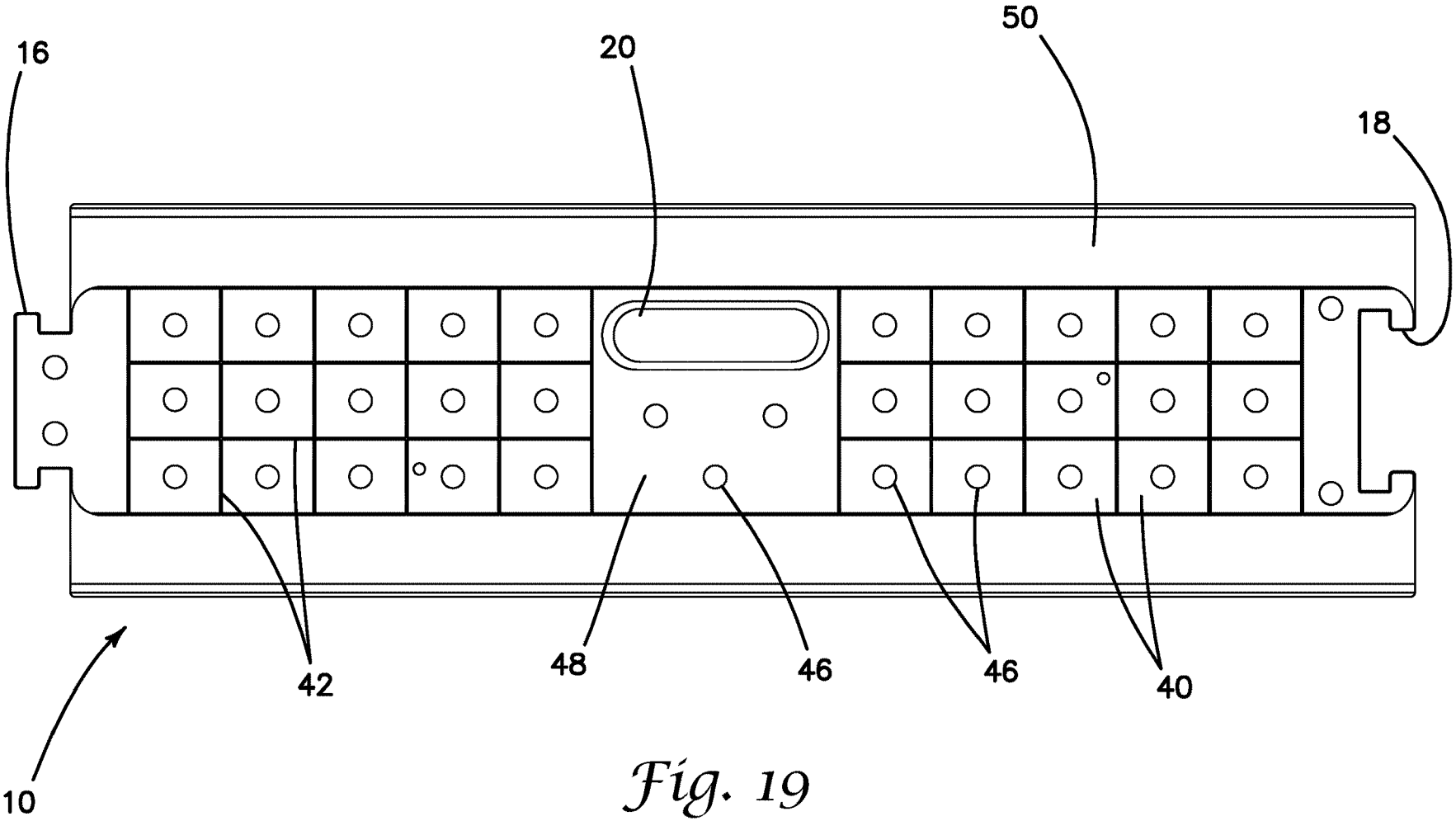
FIG. 19 is a top view of the embodiment shown in FIG. 15 with the metallic plate visible for clarity as to the construction of the warning segment assembly.

In one particular embodiment, there are twenty-eight ballast blocks 40, though, of course, this number can vary within the scope of the invention. The grid of living hinges 42, coupled with the lengthwise edges 44 of the plate 38, together define the twenty-eight ballast blocks 40, as shown in FIGS. 15, 18, and 19. As a result, each of the inside blocks 40 is defined on all four sides thereof by a living hinge 42, and the outside blocks 40 are defined by a living hinge 42 on three sides, and by the plate outside edge 44 on its remaining side.

The living hinges 42 create an extremely desirable field performance feature, which is closely spaced and controlled flexibility both axially and transversely for the warning strip segment 10 as a whole. This flexibility enables the segment 10 to easily conform to any unknown surface irregularity, which is common when dealing with uneven, potholed, or crowned road surfaces upon which the segment 10 is likely to sit when in use.

The segmented plate 38, with the individually created ballast blocks or segments 40, permits separate flexibility of individual ballast segments, one relative to another adjacent one, or groups of blocks relative to adjacent groups of blocks, in either an axial or transverse direction, while maintaining their as-manufactured, physical spacing and as-molded physical relationship to one another.

A hole 46 is drilled or otherwise created, using known fabrication techniques, in each ballast block or segment 40, as shown in FIGS. 15, 18, and 19. One or more additional such holes 46 may be formed in a center portion 48 of the plate 38. One such hole 46 is illustrated in FIG. 15, while three holes 46 are illustrated in the center portion 48 in FIG. 18 or 19—either arrangement is within the scope of the invention, as well as any other desired number of such holes 46. Holes 46 are also illustrated in each of the end portions 16 and 18. It is not required that there be a hole 46 in every segment 40, or in the center portion 48, or in the end portions 16, 18, but there should be a sufficient number of holes 46 spaced across the surface of the plate 38 to ensure the function described for the holes 46 below. In one embodiment, the diameter of each hole 46 is ¾ inch, but the size may be adjusted as desired to suit application and preferences as long as functionality is maintained. A handle hole 20 is also formed in the center region 48, in order to ensure that the finished segment includes such a handle 20. The plate 38 also includes a male protrusion 16 formed at a first end and a female receptacle 18 formed at the second end thereof, in order to ensure that the finished molded segment assembly 10 will include those features.

Now, a method for compression molding and fabricating a modular warning strip segment according to the invention will be described, in conjunction with the embodiment illustrated in FIGS. 14-20. Initially, one slab or layer of vulcanizable rubber is first laid into the top of the mold (the part is molded upside-down), over three locating pins which will protrude through the top surface of the rubber layer. The three locating pins are used to locate and precisely position the segmented metal plate 38 within the open mold, atop the initial rubber layer, the locating pins extending through locating pin holes 51 in the plate 38. Once the segmented ballast plate 38 is positioned on the three locating pins protruding through the slap or layer of rubber already placed in the mold, the tool is ready for the final step prior to molding.

Atop the first slab of rubber and the segmented steel plate 38, positioned in the mold on its three standoff pins, a second layer of vulcanizable rubber is laid. At this point, the mold is ready to be closed, with the segmented steel plate 38 sandwiched in the middle of the molded product, between the two rubber layers. In one particular embodiment, the plate 38 is about 5/16 inches thick, while each of the two rubber layers are about ¼ inch thick, though these dimensions may be modified to a certain extent, depending upon design considerations.

When the mold is closed, and the rubber is heated in the pre-heated press, the vulcanizable rubber comprising each of the two rubber layers becomes a viscous fluid. Under the tremendous pressure of the compression molding press, the molten rubber flows through the formed holes 46 in the metal plate 38. This process creates what is essentially a rubber bolt extending through each of the holes between the upper rubber layer and the lower rubber layer of the finished assembly, which ensures the stability and position of each of the three layers, relative to one another, since each of the layers and the plate are linked.

The free flowing rubber also will extrude itself into and through (if the slit 42 extends through the entire thickness of the plate 38) each of the 1/16 inch wide laser cut spaces or living hinges 42 between each ballast block 40, thereby creating a vulcanized rubber living hinge 42.

FIG. 19 illustrates a partially completed warning strip segment 10, with the top layer of rubber removed for illustrative purposes, in order to show how the metal plate 38 is situated within the assembly 10. Thus, lower rubber layer 50 is illustrated, with the metal plate 38 situated within that layer 50, as shown. The aforementioned rubber bolts fill each of the holes 46 to secure the layers and the plate together.

Figure 14:
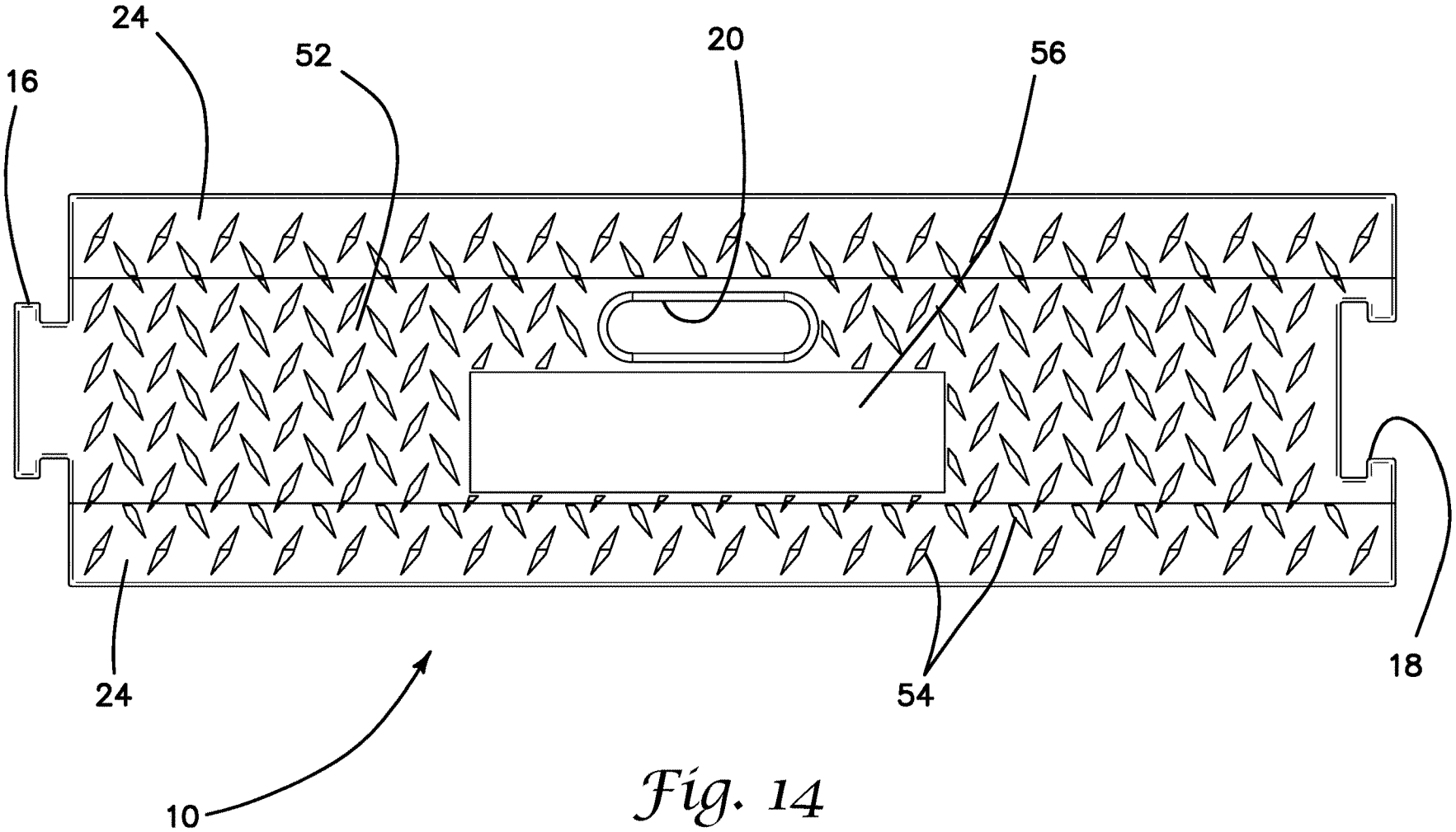
FIG. 14 is a top view of another exemplary modified embodiment of a modular warning strip segment according to the present invention.
Figure 20:
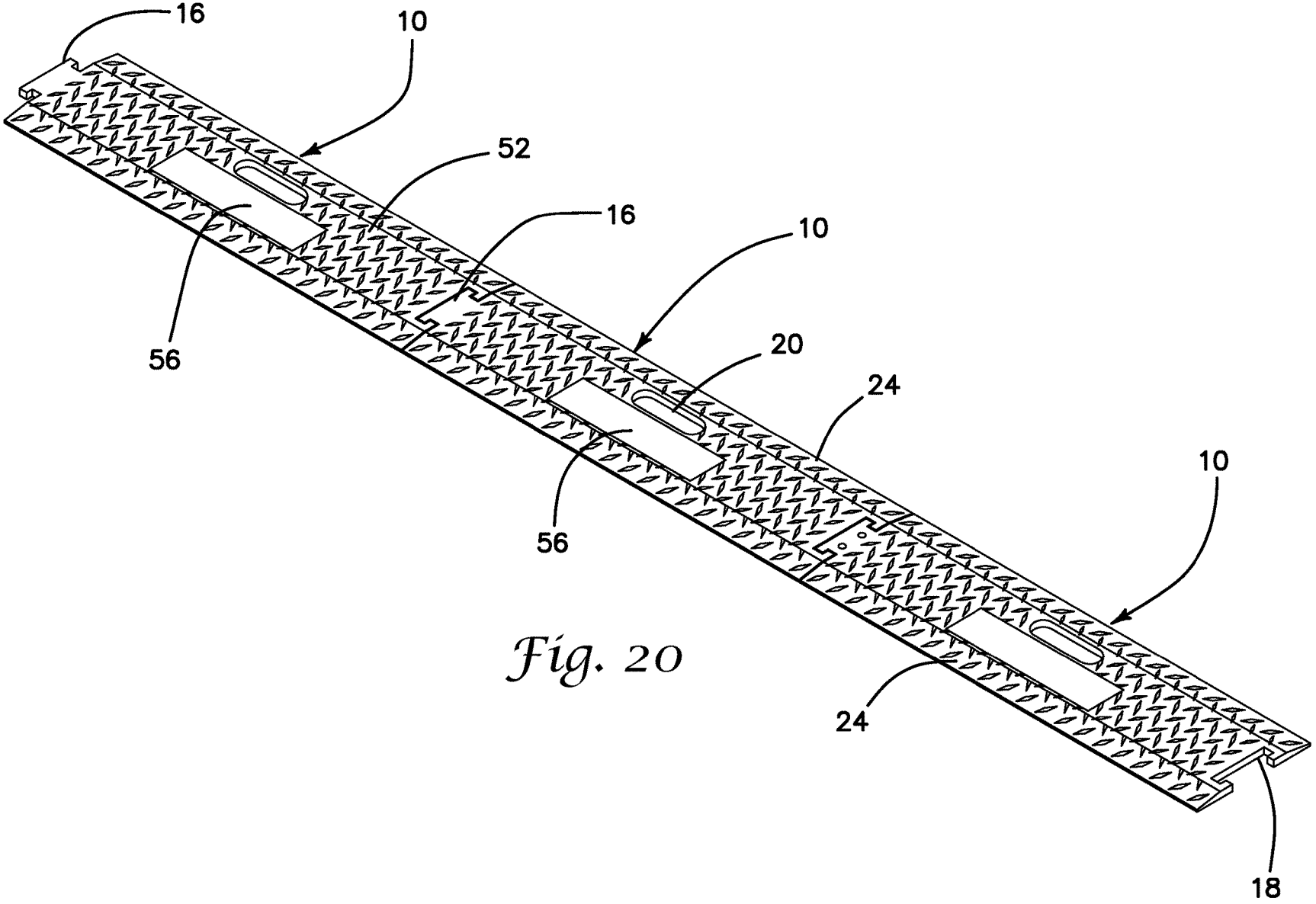
FIG. 20 illustrates an assembly of three modular warning strip segments of the type shown in FIGS. 15-19 joined end-to-end in a manner similar to the segments shown in FIG. 8.

FIGS. 14 and 20 illustrate a completed, molded warning strip segment 10, according to the invention. In these figures, the upper rubber layer 52 is shown, sandwiching the metal plate 38 between itself and the lower rubber layer 38. The top surface of the upper rubber layer 52 is substantially smooth in order to prevent injury to motorcyclists and other two-wheeled vehicles which may travel over the strip, with only optional molded traction bumps 54 disposed thereon. An information block 56 is provided, in the event it is desired to mold information therein, such as company name, contact information, model information, or the like. As shown in FIG. 20, any number of warning strip segments 10 may be joined end-to-end by securing the male protrusion 16 of one segment 10 into the female receptacle 18 of an adjacent segment 10, as shown. Although only one of each of male protrusions 16 and female receptacles 18 are disposed on each segment 10, as shown, other joining configurations could be employed, such as the one shown in FIGS. 1-13, particularly if there is a desire to join the segments 10 in an offset manner, as shown in FIG. 9.

Important objectives that are met by this invention are as follows:

1) The modular warning strip segment 10 is sufficiently heavy to stay in place with minimal movement when run over by a vehicle, but not too heavy for one person to lift, position, or handle.

2) An assembly of segments 10, when joined together as shown in FIG. 8, 9, or 20, must be rigid enough, particularly at the linkable joints, so that they do not separate from one another when a vehicle runs over them.

3) The segments 10, both individually and when assembled, must be flexible enough to conform to varied and uneven roadway surfaces. The flexibility needs to be intimately connected to an idyllic weight and closely linked to close proximity flexibility both axially and transversely, preferably.

4) The segment 10 is about 12-14 inches in width, with very gentle approaching and departing ramped portions 24, each about 1½-2½ inches in width, having lead in and exit angles of a maximum of 15 degrees, and preferably 10 degrees. Importantly, with respect to the embodiment of FIGS. 14-20, the metal plate 38 does not extend into the ramped portions 24 of the segment 10, thereby improving flexibility for positioning of the segments, and for driving over the segments and ensuring that the segments conform to the roadway surface.

5) Each segment has a maximum height of about ¾ inches with a length of about 4 feet.

6) With respect particularly to the embodiment of FIGS. 14-20, the small laser slits or living hinges 42 are a big advantage over using separate spaced plates, because positioning a single plate in the mold, rather than a plurality of separate plates, improves efficiency and precision in manufacture.

Figure 21:
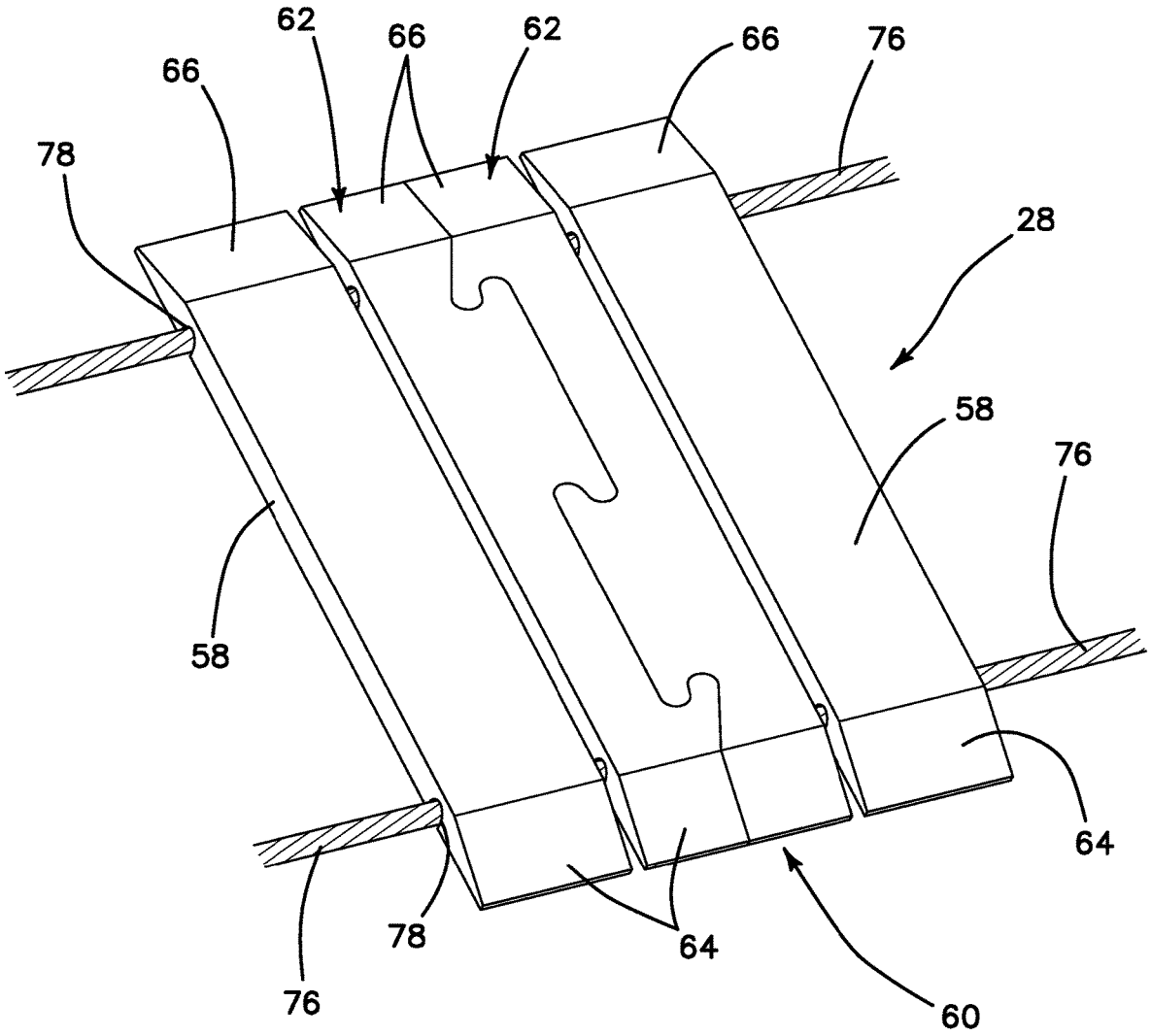
FIG. 21 is an isometric view of still another exemplary embodiment of an inventive modular warning strip segment assembly according to the principles of the present invention.
Figure 22:
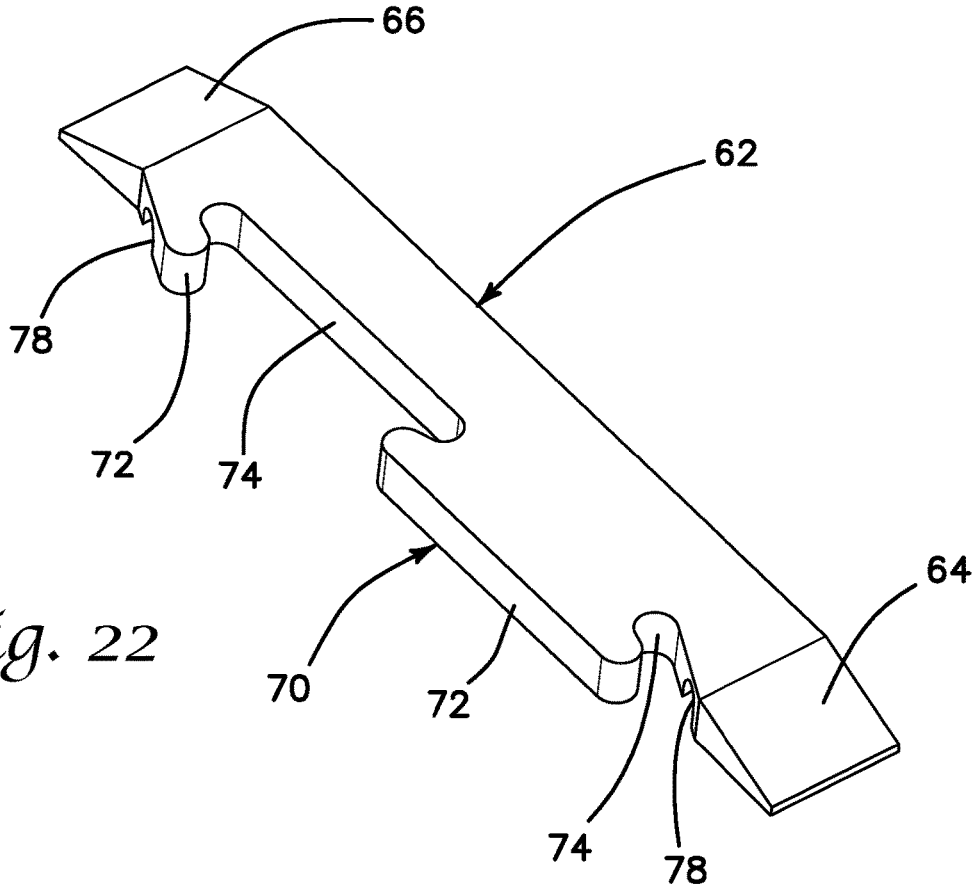
FIG. 22 is an isometric view of a portion of the center section of the warning strip segment assembly shown in FIG. 21.
Figure 23:
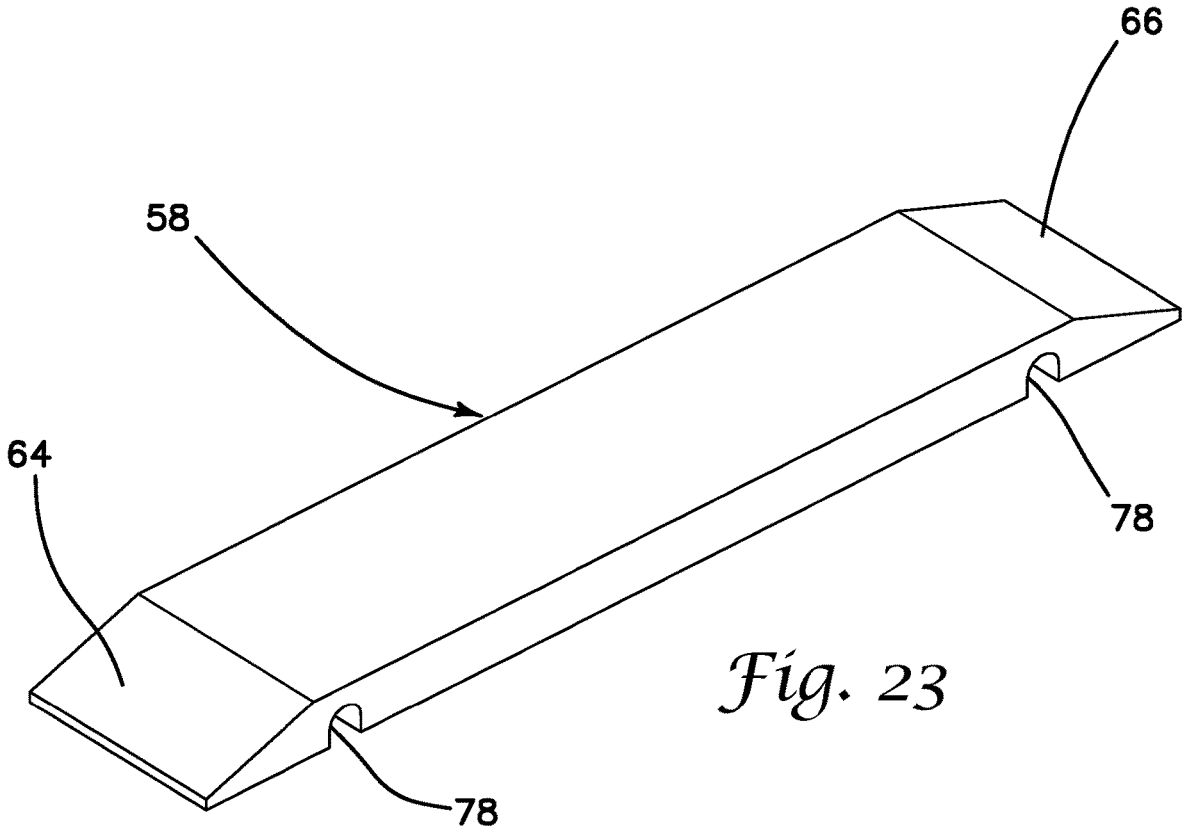
FIG. 23 is an isometric view of one of the end sections of the warning strip segment assembly shown in FIG. 21.

Another exemplary embodiment of the invention is illustrated in FIGS. 21-23. In this embodiment, a rumble or warning strip assembly 28 comprises two opposed linear segments 58 which are sandwiched about a jigsaw segment 60 comprising two joined jigsaw members 62. In certain embodiments, the segments 58 and members 62 are fabricated of steel, such as pressure-cast steel, or other suitable metal, and include tapered ramps 64, 66 on each of the leading and trailing edges, respectively. A urethane sheet, or other suitable material, may be bonded to the bottom face of each segment 58 and member 62. Non-slip, anti-corrosion coatings are applied to the top and sides thereof, as indicated. In exemplary embodiments, each of the segments 58 and members 62 are powder-coated with a flat, textured finish. Urethane strips may be adhered to the bottom surfaces of the segments 58 and members 62 lengthwise. Alternatively, the segments/members may be dipped in urethane, or injection molded with a urethane surface.

Each of the jigsaw members 62, which together comprise the jigsaw segment 60, has a straight edge 68 and a jigsaw edge 70. The jigsaw edge comprises a series of protrusions 72 and concavities 74 which are particularly designed to ensure a tight and immovable connection with corresponding protrusions and concavities on an adjacent jigsaw member edge. Of particular advantage is that the jigsaw end or edge 70 is designed to be universal. In other words, it is not either left or right-handed. So, as shown in FIG. 21, the two joined jigsaw members 62 are identical in configuration, but simply reversed in orientation.

Though the assembly 28 is illustrated as comprising two joined jigsaw members 62 (with one in reverse orientation compared to the other one), forming a jigsaw segment 60, and segments 58 joined to either edge of the jigsaw segment 60, the inventive system is completely flexible in allowing for any combination of assembly of the various segments and members illustrated in FIGS. 21-23. For example, additional segments 58 may be attached to each end of the assembly 28, or additional jigsaw segments 60 could be secured to one or both edges of the assembly 28. In some instances, it may be desirable to simply secure a plurality of segments 58 together, while in other instances it may be desirable to secure a plurality of jigsaw segments 60 together. Any such combinations are possible, depending upon design parameters and application. Individual segments and members 58, 62, respectively, may be moved into place via a boom and magnet system or other suitable approach. Manual assembly is an option.

As shown in FIG. 21, the various joined segments 58, 60 are secured together using a cord 76, which may comprise a cable, wire rope, or the like, may be formed of steel, such as braided steel, or other suitable material, and extends through openings 78, which may comprise holes or slots formed in each segment 58 and member 62. If open slots 78 are utilized, rather than holes, it may be advantageous to weld the cords in position within the slots to hold them in place.

Figure 24:
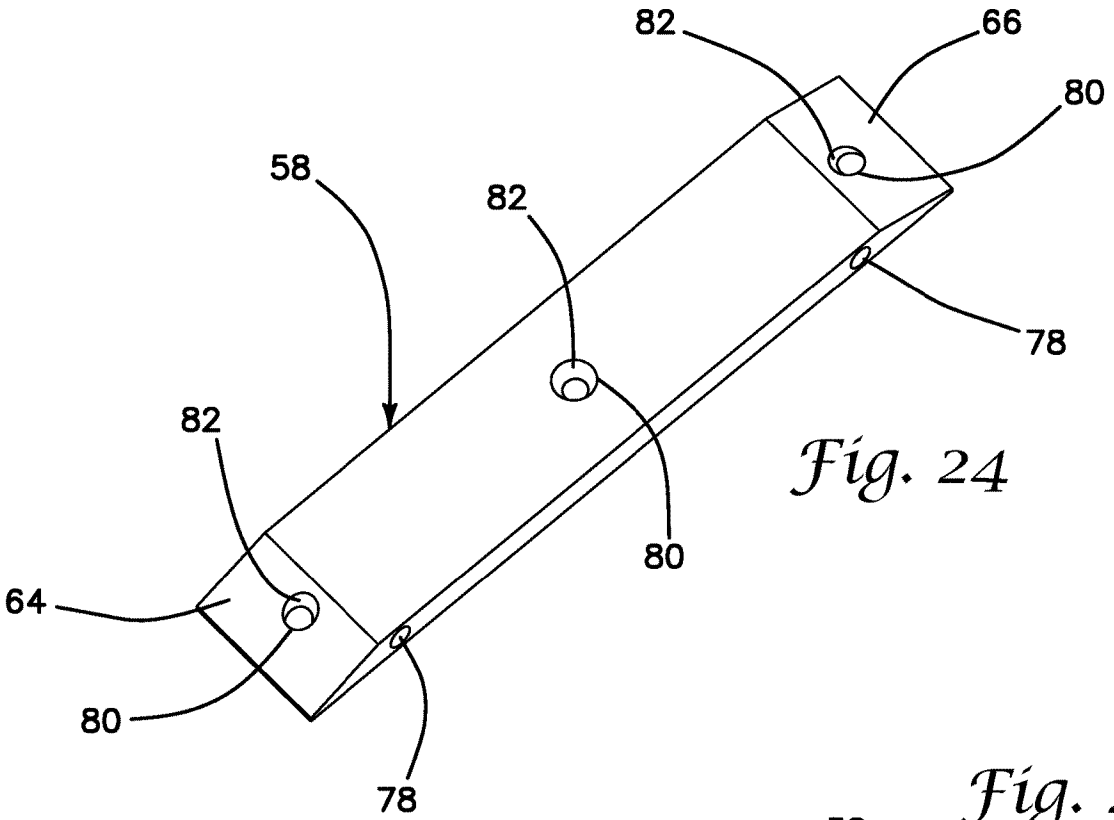
FIG. 24 is an isometric view of a section of a warning strip segment similar to end segments shown in the embodiment of FIGS. 21-23, with additional unique features.
Figure 25:
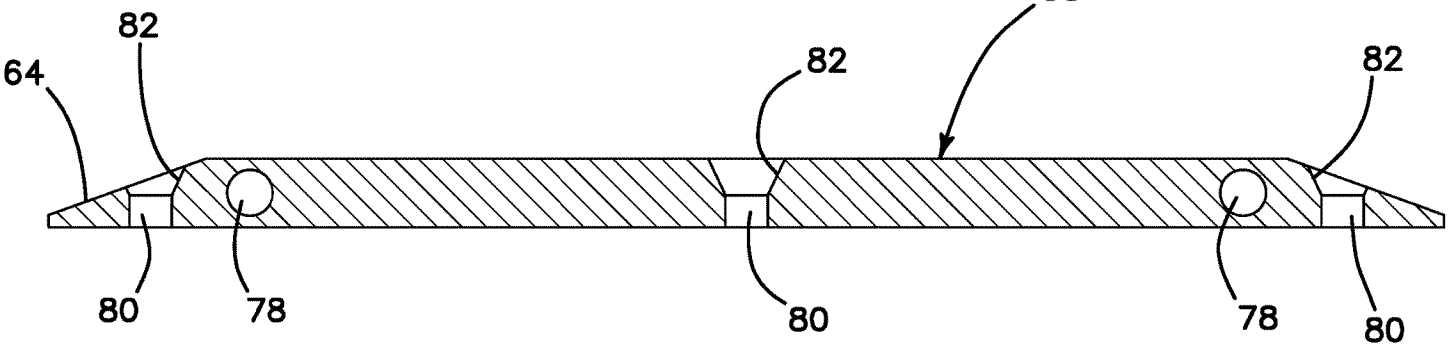
FIG. 25 is a schematic cross-sectional view of the warning strip segment shown in FIG. 24.
Figure 26:
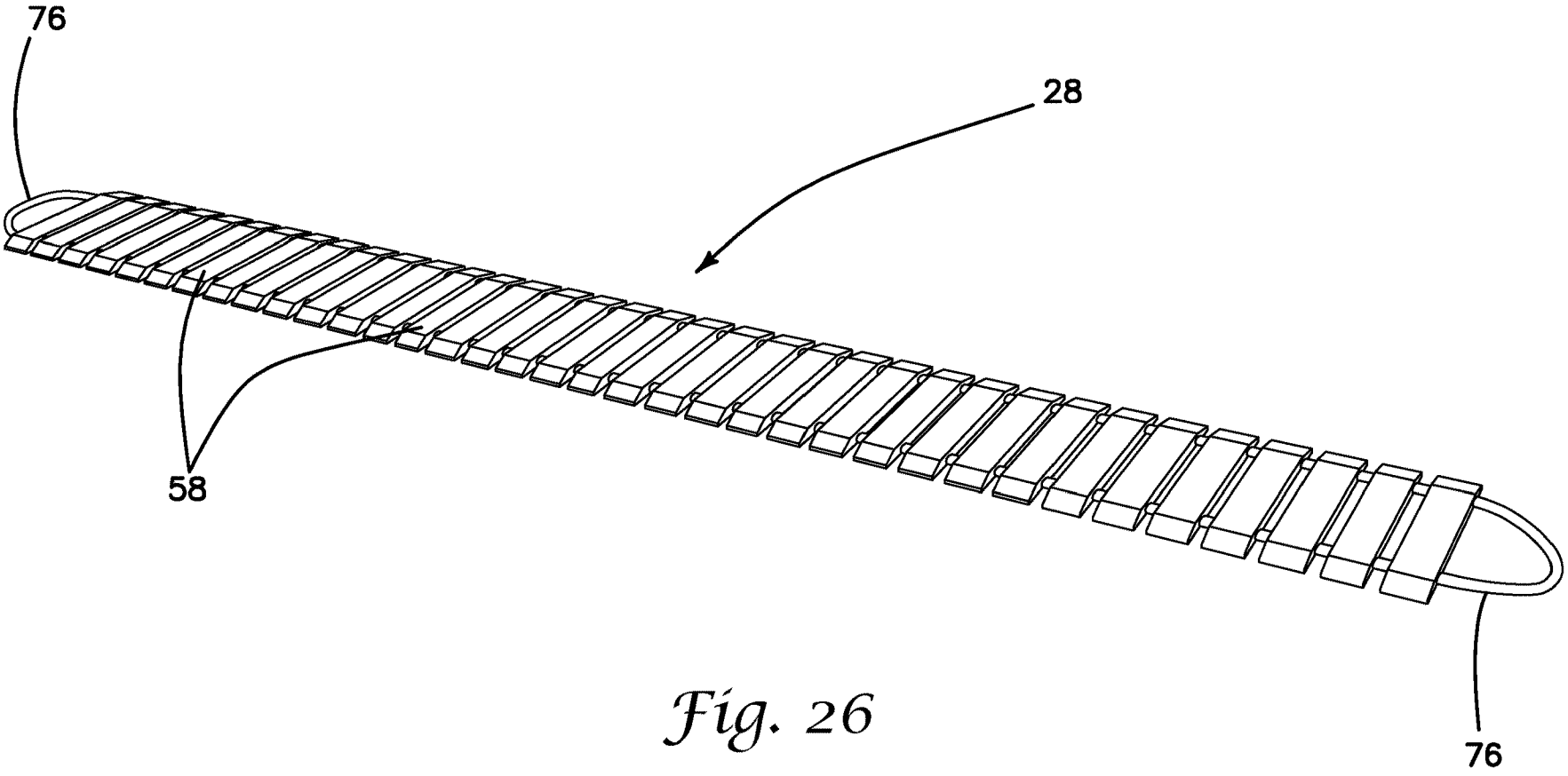
FIG. 26 is an isometric view of a warning strip segment assembly constructed using a plurality of the warning strip segments shown in any of the FIGS. 21-25.

FIGS. 24 and 25 illustrate a modified embodiment of the segments 58 shown in FIGS. 21-23, though the features shown in FIGS. 24-25 for segments 58 may also be employed in the jigsaw members 62 of FIGS. 21-23. In particular, through holes 80 are disposed in each segment 58, member 62. As illustrated, one such hole 80 is disposed in a center region of the segment, while in each of the leading and trailing edges 64, 66 another such hole 80 may be disposed as well. As shown, there is a wider bell mouth portion 82 of each of the holes 80 near a top surface of the segment.

A purpose for the through holes 80 is to serve as a locking system in the event that the urethane coating discussed above is cast in place about the segments 58 and members 62 during fabrication. Using such a method, where the urethane is cast in place, the urethane may flow through the holes 80, locking the urethane to the bar or segment.

Figure 27:
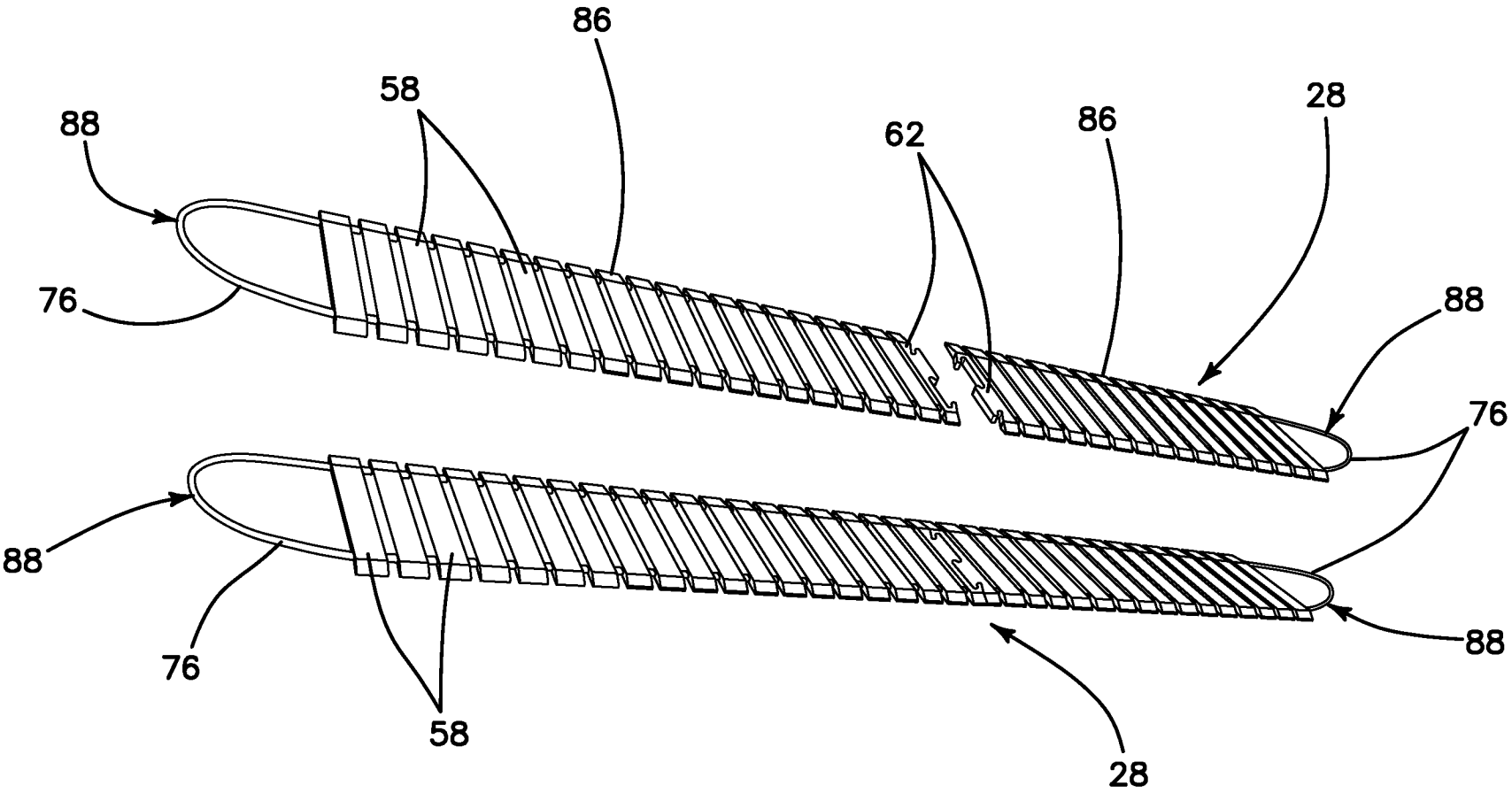
FIGS. 27-29 illustrate warning strip systems assembled by joining a plurality of joinable partial warning strip assemblies.
Figure 28:
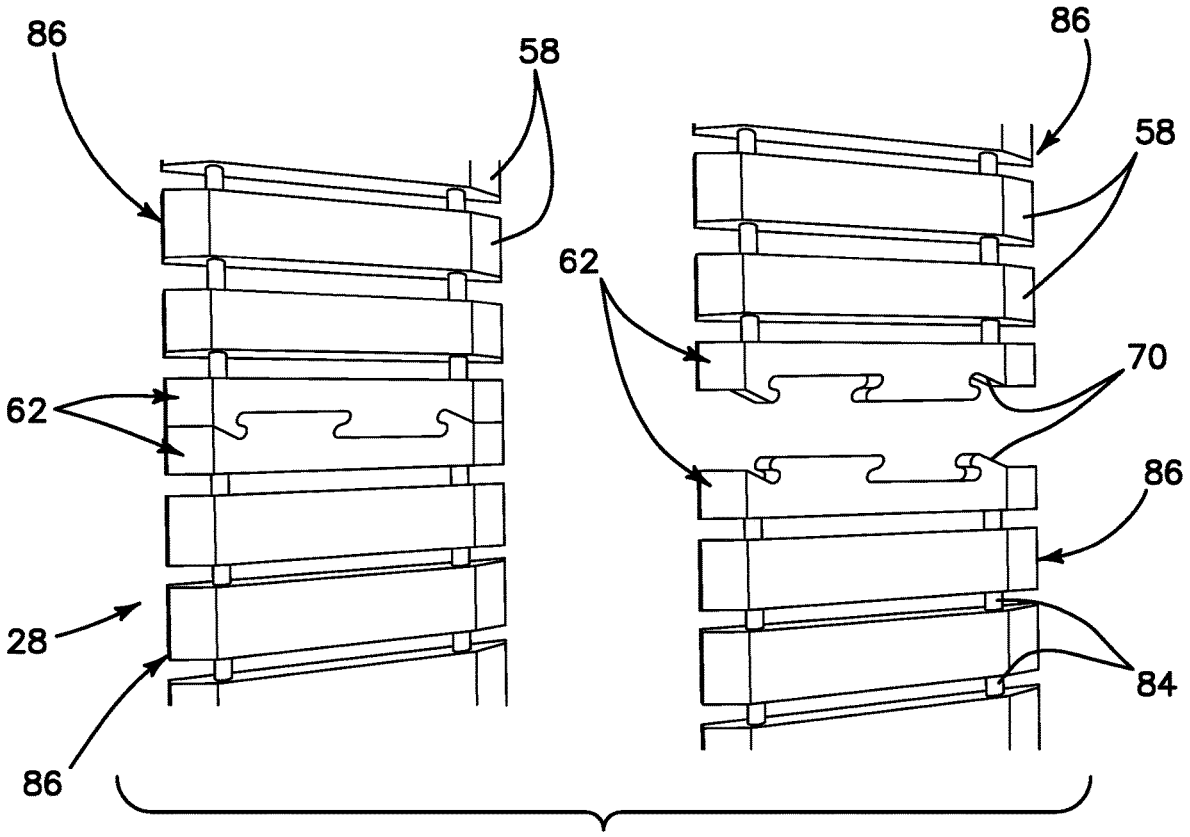
Figure 29:
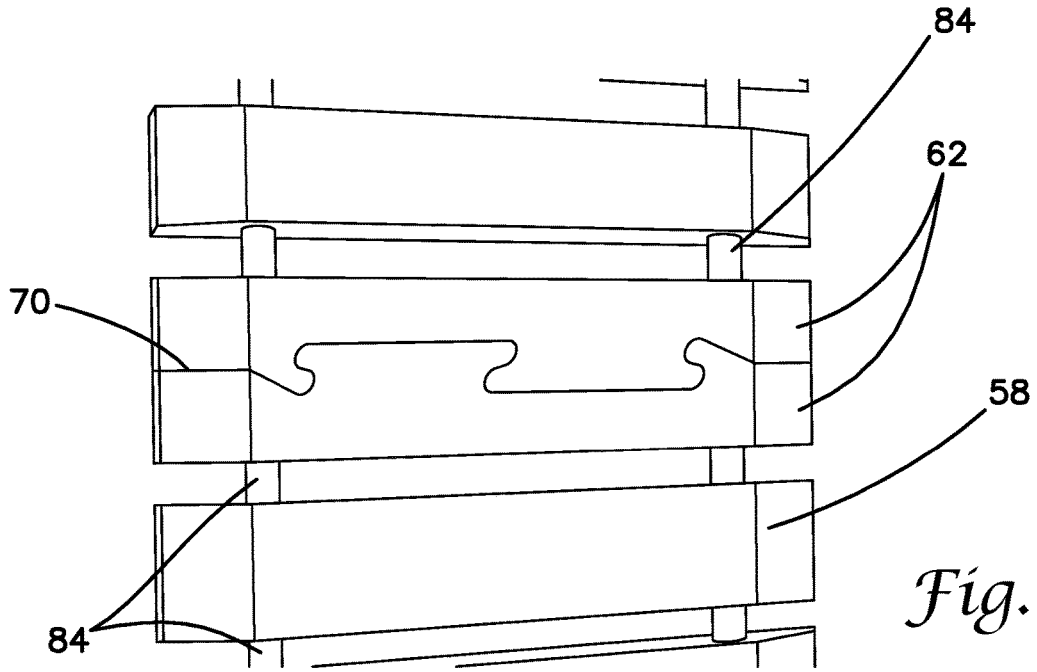

FIGS. 26-29 illustrate an example of a warning strip segment assembly 28, assembled in accordance with the principles discussed above, wherein a plurality of segments 58 are secured together with a length of cord 76, comprising a stainless steel cable. In a typical assembly, having a length sufficient to extend across a roadway lane, as shown in FIG. 27, approximately thirty or so segments, having a total weight of approximately 180 lb. or so, may be joined together as shown. Notably, as the segments are assembled together by extending a loop of cord 76 through each of the two openings 78 in each segment, thereby stringing the segments 58 together, as shown, spacers 84 are disposed on the cord 76 between each segment 58. Each spacer comprises a tube having a sufficient diameter to fit over the cord 76, and functions to ensure that a space is maintained between each segment 58, as is evident from a review of FIGS. 26-29. Such spacer tubes 84 preferably comprise a corrosion-resistant material, which has enough wall thickness to ensure adequate strength that the segment assembly 28 may be rolled up without kinking the cords 76. The spacers 84 may be comprised, for example, of copper or stainless steel.

Now, again with reference to FIGS. 26-29, a technique for assembling a warning strip assembly 28 may involve assembling a subassembly 86 (FIG. 28), which is only a portion of the size of the assembly 28, and then joining a plurality of the subassemblies 86 together to create a full assembly 28. Specifically, as noted above, a full warning strip assembly 28 can comprise thirty or more segments 58, and thereby weigh 180-210 pounds. In some circumstances, a user may not wish to move a 180 lb. assembly 28 from a truck to a roadway deployment, and would prefer to move a plurality of lighter subassemblies 86 to the deployment location, securing the subassemblies 86 to one another to assemble the full assembly on the roadway location. A subassembly of any desired size, such as, for example, 15 segments 58, is assembled over a suitable length of cord 76, with spacers 84 between each segment 58. This essentially creates a half-strip 86 having a length of 5 or 6 feet and a weight of about 104 lb, suitable for extending across about one-half of a lane of traffic. This half-strip 86 can be deployed across the roadway lane. In this arrangement, the last segment on the half-strip comprises a jigsaw segment 62, wherein the jigsaw edge 70 is exposed at the end of the half-strip. The ends of the cord 76 are welded into the openings 78 in this end jigsaw segment 62. Set screws may be disposed in the top and bottom of the segment. Then, another half-strip may be joined end-to-end, on the roadway site, to the first half-strip by securing an end jigsaw segment 62 to the first end jigsaw segment 62 by joining their respective jigsaw edges together, thereby creating a full jigsaw member which joins the two subassemblies 86 together to create a full warning strip assembly 28 covering the entire roadway lane.

Thus, to summarize, subassemblies 86 are joinable together to form a complete assembly 28 on the roadway. Cords 76 form loops 88 at one end of each subassembly 86, so that a completed assembly 28 has a cord loop 88 at each end thereof, as shown, for assisting in deploying the subassemblies/assemblies.

In an exemplary embodiment, each strip subassembly 86 is 5½ feet in length, has a jigsaw member 62 on one end, and has a cord handle 88 on the other end. Two subassemblies 86 connect together by joining respective jigsaw members 62, as shown, to make an 11 foot long assembly 28 that spans a lane of roadway.

In this exemplary embodiment, the jigsaw members 62 are identical, regardless of how they are oriented. As noted above, there are no designated "left" or "right" handed parts. The jigsaw connection is at the middle of the assembly 28, thus keeping the connection as far away from the passing vehicle tires as possible. In this particular assembly, again as previously described, the weight of each subassembly 86 is 104 lb, thereby creating an assembly 28 of about 208 lb., though these weights may vary depending upon materials and scale of size. In this example, the cord 76 connecting the assembly is corrosion resistant/marine grade ⅜" wire rope.

The bottom surface of each segment 58 and jigsaw member 62 is ⅛" thick urethane, in one particular example, bonded to the steel strips with a special two-part adhesive. The spacers 84 are made from heavy wall stainless steel.

Figure 30:
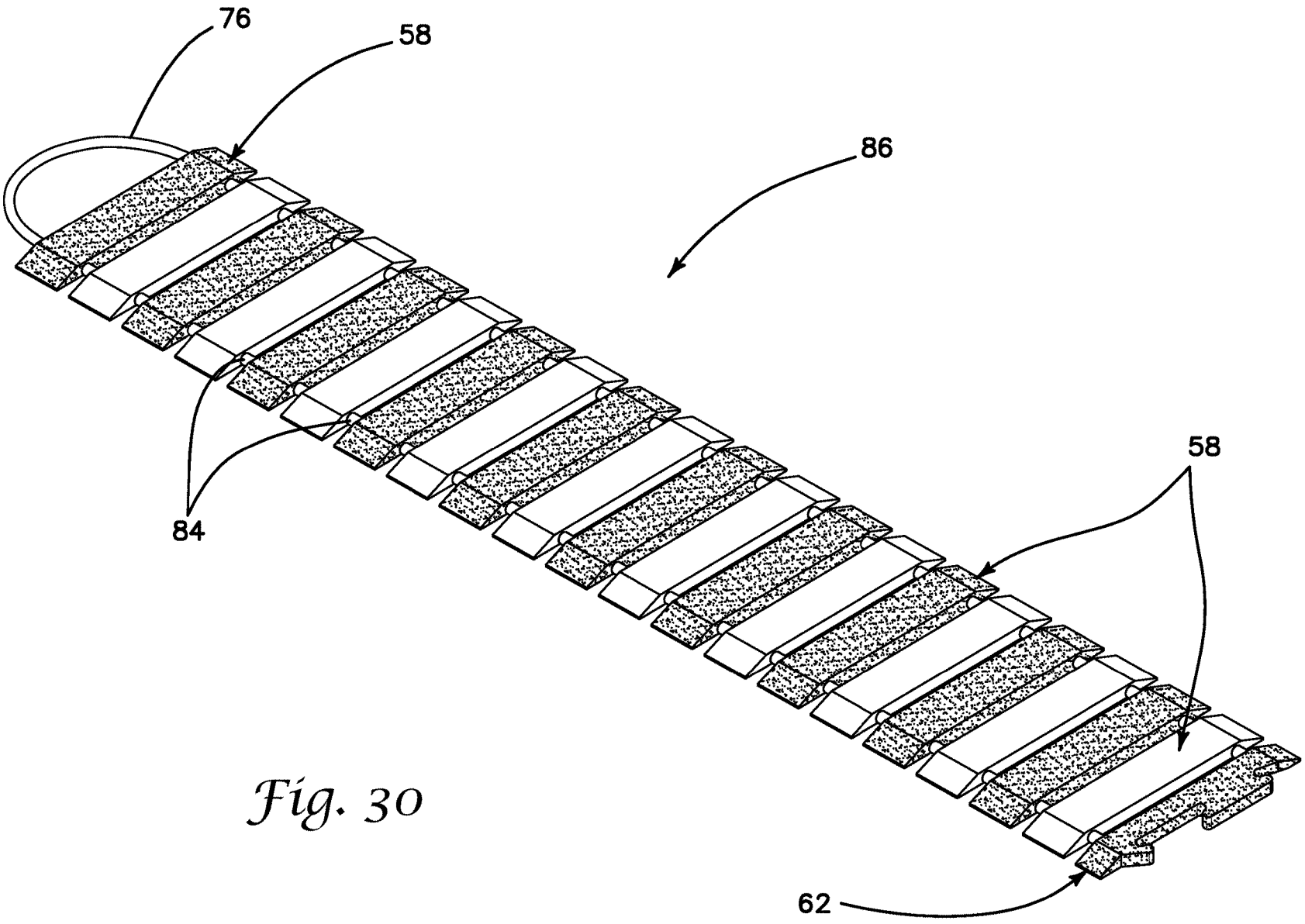
FIG. 30 is an isometric view of another exemplary modified embodiment of the inventive warning strip segment assembly.

In FIG. 30 there is illustrated still another exemplary embodiment of the present invention, which is similar to that shown in FIGS. 21-23 and 26-29, illustrating a warning strip subassembly 86, wherein all like elements to those in the embodiment of FIGS. 21-23 and 26-29 are designated by like reference numerals. The only substantial difference between this and the previous embodiment is that the subassembly 86 in this embodiment is fabricated of segments 58 and jigsaw member 62, wherein alternating, adjacent segments and the jigsaw member 62 are differently colored, alternating between darker and lighter colors, as shown. In the illustrated embodiment, the lighter colored segments 58 and jigsaw members 62 are comprised of a colored aluminum, whereas the darker colored segment 58 and jigsaw member 62 are comprised of a colored steel. Significantly, in addition to the contrasting colors of adjacent segments 58 and jigsaw member 62, the lighter-weight aluminum segments result in a much lighter subassembly 86 than in the previous embodiments. For example, in one exemplary embodiment, the subassembly 86 is approximately 80 lb, rather than 104 lb, resulting in a total weight of 160 or so lb for the assembly 28, instead of 204 or so lb. This lighter weight, of course, makes the strip assembly easier to handle. Advantageously, the contrasting alternating colors of the segments 58 and jigsaw members 62 also greatly improve visibility of the assembly 28 to approaching motorists. On dark asphalt, the lighter segments 58 and jigsaw members 62 are particularly visible, while on light concrete, the darker segments 58 and jigsaw members 62 are particularly visible.

Accordingly, although an exemplary embodiment of the invention has been shown and described, it is to be understood that all the terms used herein are descriptive rather than limiting, and that many changes, modifications, and substitutions may be made by one having ordinary skill in the art without departing from the spirit and scope of the invention.

What is claimed is:

1. A modular highway warning strip system, comprising;

a first plurality of segments assembled together to form a first warning strip subassembly having a length, each of the first plurality of segments being spaced from adjacent ones of the first plurality of segments along the first warning strip subassembly length, the first plurality of segments being assembled together along a first cord disposed along the length of the first warning strip subassembly;

a second plurality of segments assembled together to form a second warning strip subassembly having a length, each of the second plurality of segments being spaced from adjacent ones of the second plurality of segments along the second warning strip subassembly length, the second plurality of segments being assembled together along a second cord disposed along the length of the second warning strip subassembly;

the first warning strip subassembly having, at a first end thereof, a first jigsaw member comprising a connecting edge, and the second warning strip subassembly having, at a first end thereof, a second jigsaw member comprising a connecting edge, the first and second connecting edges being configured to engage with one another to create a flush connection with the first and second jigsaw members, thereby creating a joined jigsaw segment and consequent joining of the first warning strip subassembly and the second warning strip subassembly at a selected site, to form a warning strip assembly on the selected site, the joined jigsaw segment being separable from each of the first and second warning strip subassemblies.

2. The modular highway warning strip system as recited in claim 1, and further comprising a plurality of spacers disposed on each of the first and second cords along the length of each of the first and second warning strip subassemblies, each of the plurality of spacers being disposed between adjacent ones of the first and second plurality of segments in order to maintain a spacing between each adjacent segment.

3. The modular highway warning strip system as recited in claim 2, wherein each of said spacers comprises a hollow structure sized to be disposed about one of the first and second cords.

4. The modular highway warning strip system as recited in claim 3, wherein each of said spacers comprises a tube formed of a corrosion-resistant material.

5. The modular highway warning strip system as recited in claim 1, wherein each of the plurality of segments comprises an opening disposed therethrough for receiving one of the first and second cords.

6. The modular highway warning strip system as recited in claim 5, and further comprising a second opening disposed through each of the first plurality of segments and the second plurality of segments for receiving one of the first and second cords.

7. The modular highway warning strip system as recited in claim 6, wherein the first cord exits from one of the openings in an endmost segment on a second end of the first warning strip subassembly, extends in an arc toward the second opening on the endmost segment, and enters the second opening, thereby forming a handle loop on the second end of the first warning strip subassembly, the arc defining a space between the handle loop and the endmost segment sufficient to receive a human hand.

8. The modular highway warning strip system as recited in claim 7, wherein the second cord exits from one of the openings in an endmost segment on a second end of the second warning strip subassembly, extends in an arc toward the second opening on the endmost segment of the second warning strip subassembly, and enters the second opening, thereby forming a handle loop on the second end of the second warning strip subassembly, the arc also defining a space between the second handle loop and the endmost segment sufficient to receive a human hand, wherein there is a handle disposed on each end of the warning strip assembly when the first and second warning strip subassemblies are joined together.

9. The modular highway warning strip system as recited in claim 1, wherein each of the first and second jigsaw members comprise an opposing straight edge in addition to the connecting edge, the connecting edge of each of the first and second jigsaw members comprising a series of protrusions and concavities which are adapted to engage with the connecting edge of the other jigsaw member, such that when the first and second jigsaw members are joined together by engagement of their respective connecting edges, a jigsaw segment is formed.

10. The modular highway warning strip system as recited in claim 9, wherein the first and second jigsaw members are substantially identical in construction.

11. The modular highway warning strip system as recited in claim 1, wherein some or all the surfaces of each segment are covered with a protective material.

12. The modular highway warning strip system as recited in claim 11, wherein the protective material comprises urethane.

13. The modular highway warning strip system as recited in claim 1, wherein one or more of the plurality of segments are a darker color and one or more of the plurality of segments are a lighter color.

14. The modular highway warning strip system as recited in claim 13, wherein the lighter colored segments and the darker colored segments are assembled in alternating fashion.

15. The modular highway warning strip system as recited in claim 14, wherein alternating ones of the plurality of segments are formed of different materials.

16. The modular highway warning strip system as recited in claim 15, wherein some of the segments are formed of steel and others of the segments are formed of aluminum.

17. A modular highway warning strip system, comprising:

a first plurality of segments assembled together to form a first warning strip subassembly having a length, wherein the first plurality of segments are assembled and secured together using a first type of connecting system which comprises spacers to ensure separation between each of the plurality of segments;

a second plurality of segments assembled together to form a second warning strip subassembly having a length, wherein the second plurality of segments are assembled and secured together using the first type of connecting system which comprises spacers to ensure separation between each of the plurality of segments;

wherein a second type of connecting system, comprising connecting members joinable together, is utilized to join the first warning strip subassembly and the second warning strip subassembly together to form a warning strip assembly having a length longer than the length of either of the first and second warning strip subassemblies, the second type of connecting system being separable from each of the first and second warning strip subassemblies.

18. The modular highway warning strip system as recited in claim 17, wherein the connecting segments comprise a first jigsaw member disposed on an end of the first warning strip subassembly and a second jigsaw member disposed on an end of the second warning strip subassembly.

19. The modular highway warning strip system as recited in claim 18, wherein each of the first and second jigsaw members comprise a straight edge and an opposing connecting edge, the connecting edge of each of the first and second jigsaw members comprising a series of protrusions and concavities which are adapted to engage with the connecting edge of the other jigsaw member, such that when the first and second jigsaw members are joined together by engagement of their respective connecting edges, a flush connection between the first and second jigsaw members is formed, thereby creating a joined jigsaw segment and consequent joining of the first warning strip subassembly and the second warning strip subassembly at a selected site, to form the warning strip assembly on the selected site.

20. The modular highway warning strip system as recited in claim 19, wherein the first and second jigsaw members are substantially identical in construction.

21. The modular highway warning strip system as recited in claim 17, wherein the first type of connecting system comprises a first cord disposed along the length of the first warning strip subassembly, extending through holes bored through each of the first plurality of segments, the spacers being disposed on the first cord between adjacent ones of the first plurality of segments, and a second cord disposed along the length of the second warning strip subassembly, extending through holes bored through each of the second plurality of segments, the spacers being disposed on the second cord between adjacent ones of the second plurality of segments.

* * * * *